US010600301B2

(12) United States Patent
Gonzales

(10) Patent No.: US 10,600,301 B2
(45) Date of Patent: Mar. 24, 2020

(54) SMOKE DEVICE AND SMOKE DETECTION CIRCUIT

(71) Applicant: Eric V. Gonzales, Aurora, IL (US)

(72) Inventor: Eric V. Gonzales, Aurora, IL (US)

(73) Assignee: VISTATECH LABS INC., Aurora, IL (US)

( * ) Notice: Subject to any disclaimer, the term of this patent is extended or adjusted under 35 U.S.C. 154(b) by 0 days.

(21) Appl. No.: 15/994,715

(22) Filed: May 31, 2018

(65) Prior Publication Data

US 2018/0350220 A1 Dec. 6, 2018

Related U.S. Application Data

(60) Provisional application No. 62/583,704, filed on Nov. 9, 2017, provisional application No. 62/512,939, filed on May 31, 2017.

(51) Int. Cl.

| | |
|---|---|
| ***G08B 17/10*** | (2006.01) |
| ***G08B 17/117*** | (2006.01) |
| ***G08B 17/113*** | (2006.01) |
| ***G08B 29/04*** | (2006.01) |
| ***G08B 29/18*** | (2006.01) |
| *G08B 17/103* | (2006.01) |
| *G08B 17/12* | (2006.01) |

(52) U.S. Cl.

CPC ..... *G08B 17/117* (2013.01); *G08B 17/113* (2013.01); *G08B 29/043* (2013.01); *G08B 29/185* (2013.01); *G08B 17/103* (2013.01); *G08B 17/12* (2013.01)

(58) Field of Classification Search

CPC .. G08B 17/117; G08B 17/113; G08B 29/043; G08B 29/185; G08B 17/103; G08B 17/12

USPC ..... 340/628

See application file for complete search history.

(56) References Cited

U.S. PATENT DOCUMENTS 4,481,502 A * 11/1984 Dawson ..... G08B 29/145 340/512
4,533,834 A * 8/1985 McCormack ..... F23N 5/082 250/227.11
5,059,953 A * 10/1991 Parsons ..... G08B 17/12 250/342
5,281,951 A * 1/1994 Okayama ..... G08B 17/00 340/511

(Continued)

OTHER PUBLICATIONS

International Search Report from International Patent Application No. PCT/US2018/035447, dated Aug. 9, 2018.

*Primary Examiner* — Kerri L McNally
*Assistant Examiner* — Thang D Tran
(74) *Attorney, Agent, or Firm* — Greer, Burns & Crain, Ltd.

(57) ABSTRACT

A method for monitoring a location performed by one or more processors comprises receiving signals from a smoke sensor; determining one or more minutiae from the received signals; determining a time window based on the at least one determined one or more minutiae; characterizing one or more smoke or fire types in the determined time window based on one or more of the determined one or more minutiae; dynamically determining one or more alarm levels based on the characterized one or more smoke or fire types; evaluating at least one minutiae in the determined time window using the determined one or more alarm levels; and outputting an alarm signal if an alarm condition is determined.

9 Claims, 14 Drawing Sheets

(56) References Cited

U.S. PATENT DOCUMENTS

| | | | | |
|---|---|---|---|---|
| 5,673,020 | A * | 9/1997 | Okayama | G08B 17/117 340/505 |
| 5,774,038 | A * | 6/1998 | Welch | G08B 17/117 340/286.05 |
| 5,912,428 | A * | 6/1999 | Patti | F42B 3/122 102/215 |
| 6,064,064 | A * | 5/2000 | Castleman | G08B 17/12 250/339.05 |
| 7,969,296 | B1 * | 6/2011 | Stell | G08B 17/10 340/522 |
| 9,915,609 | B1 * | 3/2018 | Erdtmann | G01N 21/53 |
| 2008/0173817 | A1 * | 7/2008 | Goldstein | G01N 21/783 250/338.1 |
| 2010/0085199 | A1 | 4/2010 | Gonzales | |
| 2011/0018726 | A1 * | 1/2011 | Gonzales | G08B 29/185 340/628 |
| 2011/0298623 | A1 * | 12/2011 | Lenkeit | G08B 17/11 340/628 |
| 2013/0207807 | A1 | 8/2013 | Popper | |
| 2013/0286391 | A1 * | 10/2013 | Erdtmann | G01N 21/53 356/341 |
| 2015/0346086 | A1 * | 12/2015 | Erdtmann | G08B 17/107 250/574 |
| 2015/0371514 | A1 | 12/2015 | Bonisch et al. | |
| 2016/0213323 | A1 * | 7/2016 | Proud | A61B 5/6889 |
| 2017/0108381 | A1 * | 4/2017 | Waldron | G08B 17/12 |

* cited by examiner

SMOKE DEVICE AND SMOKE DETECTION CIRCUIT

PRIORITY CLAIM

This application claims the benefit of U.S. Provisional Application Ser. No. 62/512,939, filed May 31, 2017, and U.S. Provisional Application Ser. No. 62/583,704, filed Nov. 9, 2017, both of which are incorporated in their entirety by reference herein.

FIELD

Embodiments of the invention relate to devices and methods for smoke and fire characterization used for smoke alarms, smoke detectors, and fire panels.

BACKGROUND

Smoke alarms, detectors, and fire panels (collectively, smoke devices) have significantly decreased fire fatalities in homes and buildings respectively. However, even though touted a success, smoke devices still have known limitations that prevent their optimum effectiveness.

In 2008 a National Fire Protection Association (NFPA) committee released a report that found 20% of smoke alarms installed in US were disabled due to nuisance alarms. Nuisance alarms are primarily due to cooking. Homeowners tend to remove the battery of a smoke alarm to stop it from sounding. This leaves the homeowner unprotected when real fire occurs.

Another weakness of these life saving devices regards their ability in detecting polyurethane fires. Polyurethane (PU) is used as foam for sofas, couches, and mattresses. Smoke alarms using ionization technology are slow to detect slow smoldering PU fire, and photoelectric technology has the same limitation in detecting fast flaming PU fires.

To improve on this product category, UL STP (Underwriter Laboratory Standard Technical Panel) committee affirmatively voted in 2015 to add three additional fire tests in UL217 and UL218 testing standards. UL217 is primarily a residential standard, and UL218 is for larger systems connected to fire panels. One new requirement is for devices under test to not false alarm during burger broiling. The other two added tests are for fast PU and slow smoldering PU fire tests. During these tests, the smoke alarm/detector must notify the user before a maximum specified smoke density is reached. All smoke detectors by 2020 must pass these three tests in order to be listed at UL.

In this regard, the present inventor has recognized that it would be useful to equip a smoke device with an algorithm that recognizes the type of fire. If the smoke device can properly identify the fire and automatically change the alarm threshold, unwanted (nuisance) alarms may be prevented and PU fires detected quickly. For example, the smoke device could be configured to become less sensitive during sautéing and very insensitive during broiling. Conversely, the smoke device could be configured to automatically adjust to become very sensitive if a PU fire is detected.

There are published patent applications that describe methods for distinguishing types of fire and adjusting sensitivity accordingly. For example, Gonzales (US2010/0085199) discloses a method for tracking the rate of change of fire signal and increasing the product's sensitivity if a PU slow smoldering fire is detected. However, this method, which looks for a slow changing signal, is ineffective in distinguishing between, say, a slow PU smoldering and a slow cooking fire. Burger broiling, for example, produces very similar rate of rise as the PU smoldering fire. However, broiling should not generate an alarm, but smoldering fire should.

Another example for characterizing fire is disclosed in Conforti (US2014/0145851), where an audible alarm is issued when a particular slope reference is detected. This method is very similar to that disclosed in US2010/0085199 and also does not distinguish between smoldering fire and slow cooking fire due to their similar slopes.

SUMMARY

The present inventor has recognized that the two disclosures mentioned above may result to false positives when presented with any type of cooking fire that has a slope component similar to a smoldering profile. Baking pizza, low heat pan frying, etc. will cause nuisance alarms for both inventions described.

The present inventor has further recognized that these prior methods also have a greater problem when detecting fast flaming fires. If the above technologies are used on photoelectric detectors to detect UL fast flaming PU fire, the resulting algorithms may produce a lot of nuisance alarms from stove top cooking fires. Stove top cooking fires are mostly fast flaming and are very dynamic. These fires contain various slope signal variations that can be misinterpreted as PU fast flaming fire.

As mentioned above, nuisance alarms cause users to remove power from the smoke device, rendering them non-functional. The new UL PU fire standard requires smoke devices to become more sensitive to detect the UL PU fires. Because of this new sensitivity setting, the use of smoke alarms based on the above disclosures will further increase nuisance alarms in residences and other installations. This will result to more people disabling their smoke devices, which is an undesirable result.

The present inventor has recognized other problems for misinterpreting valid versus invalid (nuisance) alarm signals in the above prior methods. As an example, if a signal is misinterpreted as smoldering, the smoke device may automatically become sensitive. If the misinterpreted signal is broiling, then the now-sensitive product will false alarm. Further, if a signal is misinterpreted as broiling, the smoke device will automatically become insensitive. If the misinterpreted signal is really due to a smoldering fire, then the now insensitive product will not detect the valid fire.

According to an embodiment of the invention, an example detection circuit including or embodied in one or more processors for monitoring a location comprises a minutiae computer module configured for receiving signals from a smoke sensor and determining one or more minutiae from the received signals; a ripple detector start/reset timer module configured for receiving the determined one or more minutiae and determining at least a start time for evaluating one or more of the one or more minutiae; a scheduler/minutia analyzer and fire type probability analyzer module configured for evaluating the one or more of the one or more minutiae and characterizing the one or more of the one or more minutiae according to one or more smoke or fire types; a fire type and alarm level selector configured for setting one or more alarm levels based on the characterized one or more smoke or fire types; and an alarm level detector for evaluating at least one minutiae using the set one or more alarm levels and outputting an alarm signal if an alarm condition is determined. A smoke device according to an example embodiment comprises the detection circuit, the smoke sensor, and an alarm.

According to another embodiment of the invention, a method for monitoring a location comprises receiving signals from a smoke sensor and determining one or more minutiae from the received signals; receiving the determined one or more minutiae and determining at least a start time for evaluating one or more of the one or more minutiae; evaluating the one or more of the one or more minutiae and characterizing the one or more minutiae according to one or more smoke or fire types; setting one or more alarm levels based on the characterized one or more smoke or fire types; and evaluating at least one minutiae using the set one or more alarm levels and outputting an alarm signal if an alarm condition is determined.

According to another embodiment of the invention, a method for monitoring a location performed by a processor comprises receiving signals from a smoke sensor; determining one or more minutiae from the received signals; determining a time window based on at least one of said determined one or more minutiae; characterizing one or more smoke or fire types in the determined time window based on one or more of said determined one or more minutiae; dynamically determining one or more alarm levels based on the characterized one or more smoke or fire types; evaluating at least one minutiae in the determined time window using the determined one or more alarm levels; and outputting an alarm signal if an alarm condition is determined.

According to another embodiment of the invention, a detection circuit embodied in one or more processors for monitoring a location comprises a minutiae computer module configured for receiving signals from multiple smoke sensors and determining one or more minutiae from the received signals; a minutia analyzer and fire type probability analyzer module configured for evaluating the one or more of the determined one or more minutiae and distinguishing the one or more of the one or more minutiae as corresponding to either a slow progressing fire type or at least one fire type other than a slow progressing fire type; a fire type and alarm level selector configured for setting one or more alarm levels based on the distinguished slow progressing fire type or the at least one fire type other than the slow progressing fire type; and an alarm level detector for evaluating at least one minutiae using the set one or more alarm levels and outputting an alarm signal if an alarm condition is determined.

According to another embodiment of the invention, a method for monitoring a location comprises receiving signals from a plurality of smoke sensors and determining one or more minutiae from the received signals, the smoke sensors comprising at least one sensor selected and/or configured to detect smoldering fire, and at least one or more sensors selected and/or configured to detect fast flaming fire; evaluating the one or more of the one or more minutiae and distinguishing the one or more of the one or more minutiae as corresponding to either a slow progressing fire type or at least one fire type other than a slow progressing fire type; setting one or more alarm levels based on the distinguished slow progressing fire type or the at least one fire type other than the slow progressing fire type; and evaluating at least one minutiae using the set one or more alarm levels and outputting an alarm signal if an alarm condition is determined.

DETAILED DESCRIPTION

Figure 1A:
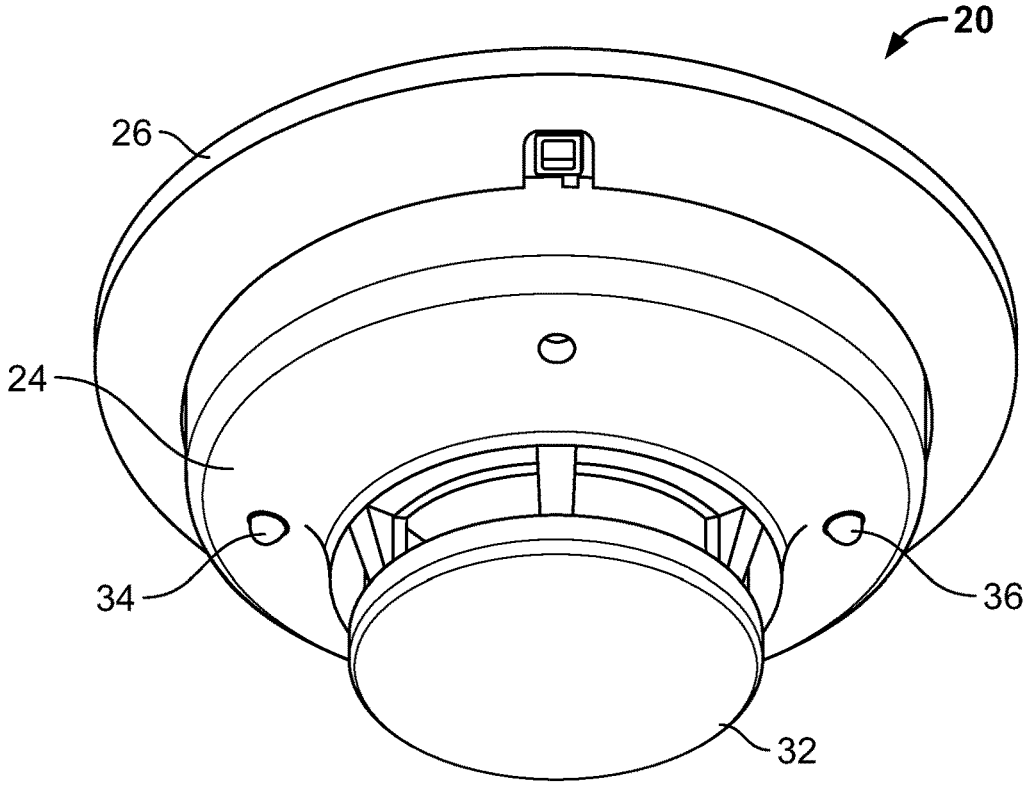
FIGS. 1A and 1B show, respectively, examples of a smoke device, particularly a smoke detector and a smoke alarm, according to embodiments of the present invention.

The above-disclosed conventional methods only evaluate slope or amplitude of the smoke profile. Other parameters and their combinations, such as negative velocity, average velocity, acceleration, and average acceleration of the signal at or around the detection point are not considered. The present inventor has recognized that a dramatic acceleration of the fire signal may be used to immediately trigger an alarm notification. Also, equal velocities can be differentiated by specifying at what amplitude they occur.

All different parameters, including but not limited to amplitude, differential amplitude, velocity, negative velocity, average velocity, acceleration, deceleration, and average acceleration, are herein collectively referred to as "minutiae." Minutiae such as amplitude, velocity, acceleration, and their averages may be common between fires. Smoldering, broiling, baking, etc. have the same slow slope and amplitude signals. UL smoke box, stove top cooking, PU fast flaming, etc. have common high value slopes.

However, the above-mentioned disclosures consider a single signal characteristic, i.e., slope, threshold, or amplitude, at only one point of time. The present inventor has discovered that analysis made on multiple time periods using multiple minutiae improves effectiveness of prediction. Multiple time period analysis will be more effective, for example, in identifying a paper fire. Such a fire will accelerate and then decelerate multiple times ending with almost zero slope and non-zero amplitude. If one knows, for example, that the first peak will occur between $t_1$ to $t_2$ seconds, the valley at $t_3$ to $t_4$ seconds, and second peak between $t_5$ to $t_6$ seconds, etc., one can check for the minutiae characteristics in each window of time. The resulting probability can be a combination (e.g., the product) of the probabilities or scores in each window of time. Conversely, one can alternatively look for specific minutiae characteristics and assign probabilities or scores based on their window of time occurrence.

An additional deficiency of prior art methods is that they only detect the point where a product should alarm. By contrast, embodiments of the present invention can seek to identify the type of fire first and then modify the alarm threshold conditions appropriately.

Embodiments of the present invention thus provide, among other things, time based analysis of smoke and fire signals using multiple signal characteristics. Example embodiments can further consider various minutiae characteristics and their combinations to generate an alarm condition. For example, after identifying the type of fire, an alarm can be issued if a certain amplitude or velocity or acceleration is reached.

Example devices and methods according to the present invention also can consider not merely whether a certain slope (or, in general, a reference minutiae) will occur, but rather when such reference minutiae occur with respect to a start of a fire. Example devices can also consider the values of other minutiae at the point of occurrence.

For example, a PU smoldering fire will start but will take a significant time to smolder until a reference minutiae level is reached. In contrast, burger broiling will reach the reference minutiae level quickly after the oven is turned on. If the time of occurrence is almost the same, one can look at the values of slope, acceleration, or other minutiae at the point of detection to further differentiate. As an example, burger broiling has a different signal velocity and acceleration compared with smoldering (as computed from UL generated fires) at some given point in time.

Figure 1B:
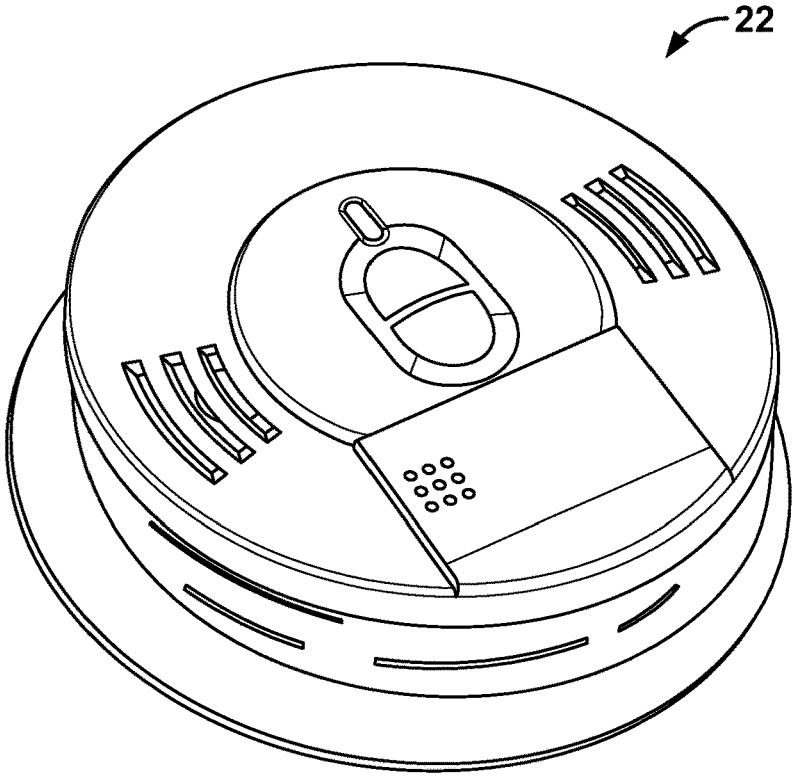

Turning now to the drawings, an example embodiment of the invention is a smoke device, such as a smoke detector, having a detection circuit configured (e.g., programmed using processor-executable instructions, wired, arranged, etc.) to perform one or more example methods. FIG. 1A shows an example smoke device embodied in a smoke detector 20. FIG. 1B shows another example smoke device embodied in a smoke alarm 22. Those of ordinary skill in the art will appreciate that the description herein with respect to the smoke detector 20 is also generally applicable to other smoke devices such as the smoke alarm 22, fire panels, etc. Systems of smoke devices, and methods for configuring and/or operating such smoke devices and systems, are also provided according to example embodiments.

Figure 2A:
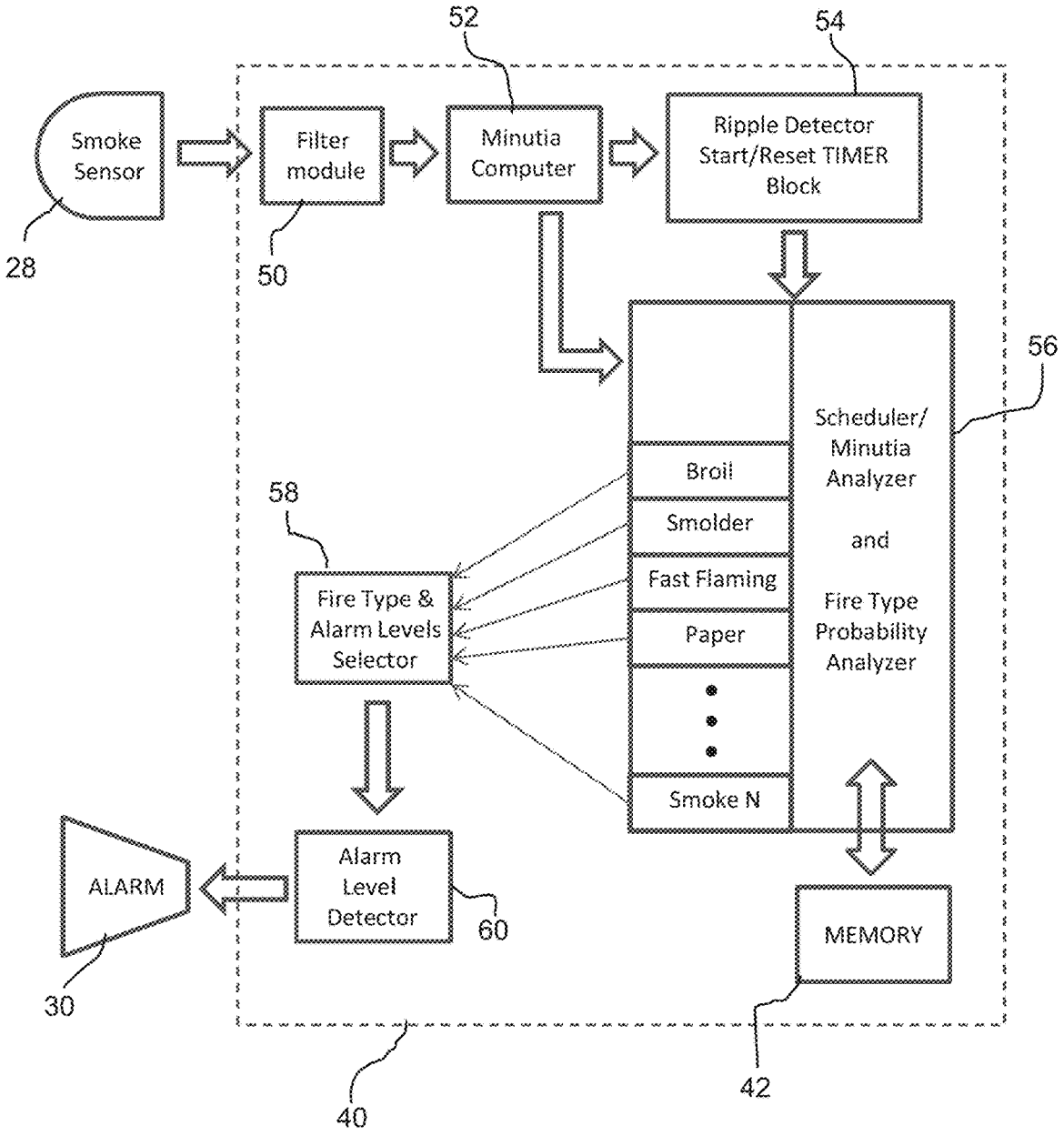
FIG. 2A shows components of the smoke device of FIGS. 1A-1B.
Figure 2B:
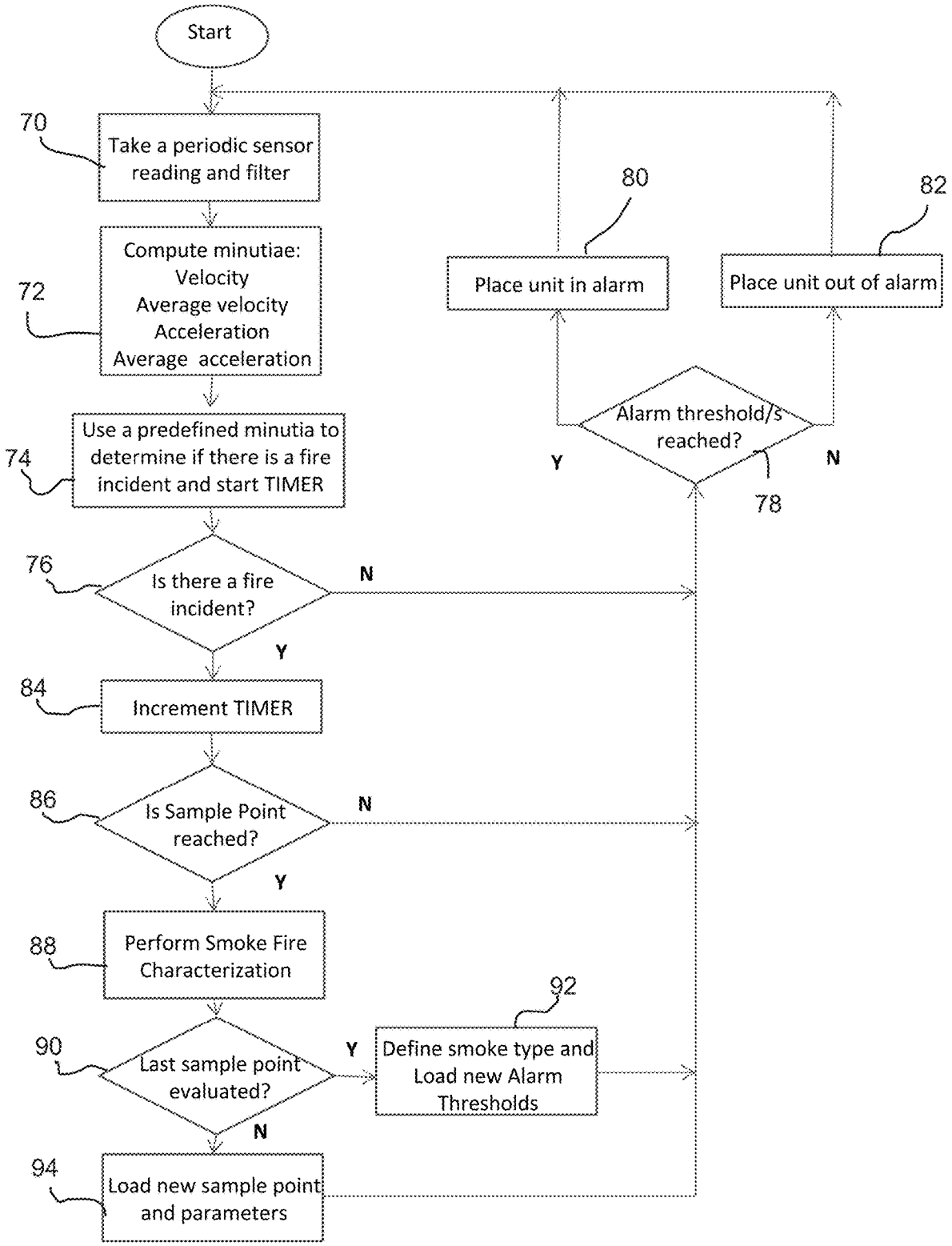
FIG. 2B shows steps in an example method for monitoring a location.

The smoke detector 20 includes a housing 24, which may be connected to a surface using a mount 26 as will be appreciated by those of ordinary skill in the art. Referring also to FIG. 2A, a smoke sensor 28 and an alarm 30 can be disposed in the housing 24, but may alternatively or additionally be disposed outside of the housing. The smoke sensor 28 can include, for instance, an ionic sensor, an optical or photo sensor (e.g., an optoelectronic sensor), a carbon monoxide detector, and/or one or more heat sensors. The different types of sensors can be used individually or in any combination. If a combination of sensors (of same or varying sensor types) is used, example methods disclosed herein an analyze minutiae (or sets of minutiae) from each sensor on combination circuitry to combine the sensor results. Combining sensor results can include analyzing in parallel, in series, in weighted or unweighted combinations, or in other ways.

Example alarms 30 include sound generators such as horns 32 (FIGS. 1A-1B), buzzers, sound generating chips, speakers, etc., light generators such as light emitting diodes (LEDs) 34, etc., output signal generators to output a data signal to a (wired or wirelessly) connected device or system indicating an alarm condition, or any combination of these. The smoke detector may also include one or more status indicators 36, such as LEDs, which may also provide features of an alarm.

The smoke sensor 28 and the alarm 30 are coupled, wired or wirelessly, to a detection circuit 40 (shown in broken lines in FIG. 2A) including or embodied in one or more processors, e.g., microprocessors, computers, etc., which are configured to perform one or more methods disclosed herein. In the smoke detector 20 or the smoke alarm 22, for instance, all or a portion of the detection circuit 40 can be disposed within a housing such as or similar to housing 24. For a smoke device including a fire control panel, readings from smoke sensors (e.g., from smoke sensors 28 used in smoke detectors 20) can be sent to the fire control panel having the detection circuit 40 or a portion thereof for performing analysis methods as disclosed herein. One or more of the components in the detection circuit 40 can be distributed among multiple locations and communicate with one another either wired or wirelessly.

Signal lines (e.g., electrical or signal connections, bus, wireless connections, etc.) (not shown) are provided to connect the smoke sensor 28 and the alarm 30 to the detection circuit 40, or to connect portions of the detection circuit. The detection circuit 40 can include a power supply (not shown), e.g., a power supply shared with other components of the smoke device, which power supply may be wired (e.g., an AC input) and/or wireless (e.g., battery (including but not limited to battery backup), solar cell, inductive power, etc.). Other components, such as one or more physical input devices (e.g., buttons) (not shown), a memory 42 (e.g., non-volatile memory, which may be separate or integrated with the processor), etc., can also be provided in or with the smoke detector 20 as part of the detection circuit 40 or in communication with the detection circuit. A plurality of smoke detectors 20 can be provided and interconnected with one another via wired or wireless connections to provide a system (e.g., a network) of smoke detectors.

An example processor providing the detection circuit 40 can include, for instance, a chip such as a microprocessor programmed via hardware, software, and/or firmware to perform example methods of the invention. A nonlimiting example processor is MicroChip PIC16LF1509.

FIG. 2A shows example components (modules) for the detection circuit 40. A filter module 50 receives and filters signals from the smoke sensor 28 and forwards the filtered signals to a minutiae computer module 52, an example operation of which will be described below. Example filtering performed by the filter module 50 includes but is not limited to hardware filtering such as (but not limited to) Butterworth or Chebyshev filters, and/or software filtering such as (but not limited to) a filter programmed to filter an incoming (e.g., digital) signal using $y(n)=(1-2^{-k})\times y(n-1)+x(n)$, where x is the input, y is the output, and n is the sample index.

The minutiae computer module 52 outputs to a ripple detector start/reset timer block module 54, and to a minutiae analyzer and fire type probability analyzer module 56, which interfaces with the memory 42. The scheduler/minutiae analyzer and fire type probability analyzer module 56 is in communication with a fire type and alarm levels selector module 58. An alarm level detector module 60 in communication with the fire type and alarm levels selector module 58 detects a fire based on the output of the fire type and alarm levels selector. The alarm level detector module 60 outputs a signal to the alarm 30 for sounding the alarm or otherwise communicating an alarm state based on the detected level. It will be appreciated that each of the modules disclosed herein can be embodied in one or more individual modules (or subcomponents), and may be co-located or distributed among multiple locations. Thus, a detection circuit as disclosed herein need not require that all modules be co-located or contained within the same housing, though it is possible in some example embodiments.

An example operation of the detection circuit 40 for monitoring a location (such as but not limited to an interior of a building, structure, or residential hallway) will now be described with reference to FIGS. 2B-10. Generally, referring to FIG. 2B, the filter module 50 of the detection circuit 40 acquires a periodic sensor reading from the smoke sensor 28, and optionally filters the sensor reading 70. Using the (filtered) sensor readings, the minutiae computer 52 then computes one or more minutiae, including but not limited to velocity, average velocity, acceleration, and average acceleration 72.

One or more predefined minutiae are then used to determine whether there is a fire incident; i.e., whether a significant deviation from expected sensor values are present. The predefined minutia are also used by the ripple detector start/reset timer block module 54 to start a timer 74. Example methods for starting, incrementing, and resetting the timer are provided in FIGS. 3-5. If it is not determined that a fire incident is present 76, the detection circuit 40 determines whether an alarm threshold has been reached 78. Examples methods for such a determination are discussed herein. If an alarm threshold has been reached, and thus an alarm condition is present, the detection circuit 40 places the smoke device in alarm 80. Otherwise, the detection circuit places the smoke device out of alarm 82. The detection circuit 40 then returns to step 70 to acquire (and filter) new periodic reading.

If a fire incident is detected 76, a timer (e.g., TIMER) is incremented 84 by the ripple detector start/reset timer block module 54. If a sample point has been reached 86, depending on either a certain amount of elapsed time or the presence of a particular minutiae as explained below, a smoke-fire characterization is performed by the fire-type probability analyzer 56 to predict the smoke-fire type (i.e., fast flaming, broiling & baking, smoldering, paper, etc.) 88. Example methods for characterizing the smoke-fire type are provided in FIGS. 6-9. If not, the example process determines whether an alarm threshold has been reached 78.

Figure 10:
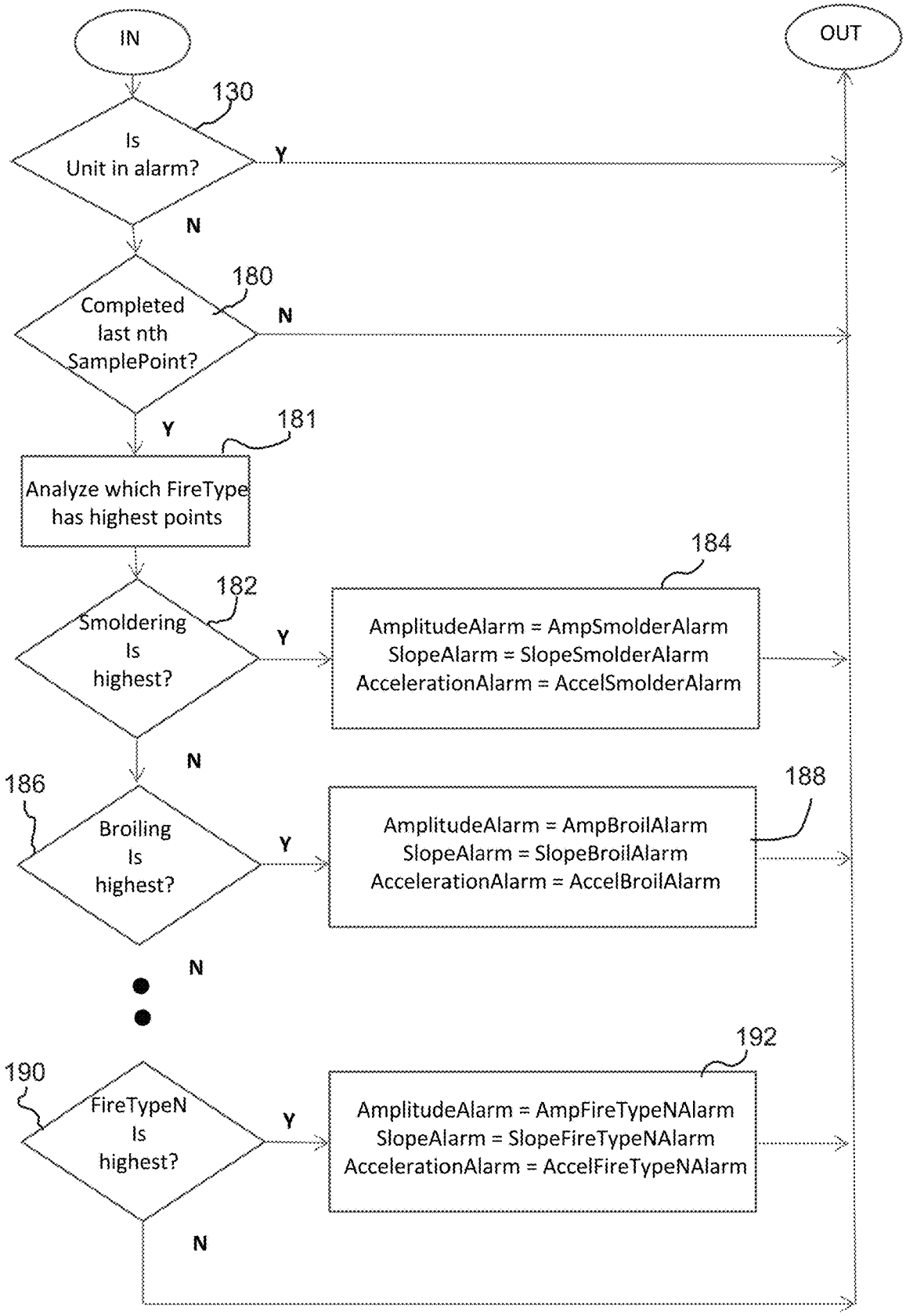
FIG. 10 shows an example method for changing alarm parameters.

If the last sample point has been evaluated 90, the fire type and alarm levels selector module 58 defines the smoke-fire type, and changes (adjusts) an alarm threshold dynamically 92 to appropriately respond to the defined fire-smoke incident type, as shown by example in FIG. 10. The new alarm thresholds are loaded into the memory 42. Using the adjusted alarm threshold, minutiae from the minutiae computer module 52, which may or may not be the same minutiae used to predict the type of fire, is compared to the determined alarm threshold by the alarm level detector 60 at step 78 to detect an alarm state. If the last sample point has not been evaluated 90, a new sample point and parameters are loaded from the memory 42, and the process goes to step 78 to determine whether an alarm threshold has been reached.

For smoke sensors 28 using ionization technology, changing the alarm threshold is preferably performed such that the detection circuit 40 is very sensitive in smoldering fires, medium sensitivity in fast flaming, and insensitive during broiling or baking. By contrast, smoke sensors 28 using photo technology respond differently, and changing the alarm threshold is preferably performed such that the detection circuit 40 becomes very sensitive during polyurethane (PU) fast flaming fire, medium sensitivity in wood/paper, and insensitive in broiling and smoldering. Alarm levels for minutiae such as amplitude, velocity, and acceleration are changed by the fire type and alarm levels selector module 58 to appropriate values corresponding with the type of smoke fire detected.

In an example method for computing minutiae, several samples are taken from the smoke sensor 28 (or the filter module 50, if used), and averaged at predetermined time periods, e.g., every $T_p$ seconds (e.g., every 10 seconds, though this number can be greater or larger). The value from the smoke sensor 28 or filter module 50 can be referred to as the filtered new amplitude (AMPLITUDENEW). The amplitude in some embodiments can also be a differential amplitude. When not sampling, the minutiae computer 52 can sleep using a watch dog timer. The filtered amplitudes AMPLITUDENEW are stored into memory locations stored in the memory 42, e.g., memory locations $m_0$, $m_1$, $m_2$, $m_3$, $m_4$, $m_5$, $m_6$, $m_7$, $m_8$, $m_9$ (this can be extended to $m_n$ memory locations) every $T_p$ seconds.

To compute for slope, e.g., every Tp seconds, the minutiae computer 52 can determine SLOPENEW=($m_0$−AMPLITUDENEW). '$m_0$' can be, for instance, a stored AMPLITUDENEW taken a certain time, e.g., 100 seconds, away from the AMPLITUDENEW. The variable $m_0$ is one of the stored memories ($m_0$, $m_1$, $m_2$, $m_3$, $m_4$, $m_5$, $m_6$, $m_7$, $m_8$, $m_9$) in memory 42.

Preferably, the (for example) ten $m_n$ storage locations have a first-in-first-out functionality. For example, once SLOPENEW is computed, the AMPLITUDENEW is stored into $m_9$. The value on mg is moved to $m_8$ and the value on $m_8$ is moved to $m_7$, etc. The value on $m_0$ is discarded when a new value is placed into this memory. Calculated slopes, SLOPEs, are stored into memories $dt_0$, $dt_1$, $dt_2$, $dt_3$, $dt_4$, $dt_5$, $dt_6$, $dt_7$, $dt_8$, $dt_9$ every $T_p$ seconds (this can be extended to $dt_n$ memory location). Preferably, the ten $dt_x$ storage locations also have a first-in-first-out functionality. For example, after SLOPENEW is computed SLOPENEW is stored into $dt_9$. The value on $dt_8$ is moved to $dt_8$, and the value of $dt_8$ is moved to $dt_7$, etc. The value on $dt_0$ is discarded when a new value is placed in this memory location.

To compute for average slope, the minutiae computer module 52 can calculate AVERAGE SLOPE, which is the summation of $dt_0$ thru $dt_9$ (the value may be divided by the total time, e.g., 100 seconds, or any arbitrary number that will facilitate computation). After SLOPENEW is stored into $dt_9$, the minutiae computer module 52 computes for AVERAGE SLOPE. AVERAGE SLOPE can be computed and evaluated, for instance, every $T_p$ seconds. In an example method, AVERAGE SLOPE is used primarily to determine if there is a potential smoke/fire activity. If a potential activity is detected, a timer (e.g., TIMER) is initiated. To calculate for acceleration, after SLOPENEW is stored into $dt_9$, ACCEL is computed as $dt_9$−$dt_8$. Those of ordinary skill in the art will appreciate that velocity (or negative velocity), acceleration (or negative acceleration/deceleration), average velocity, or average acceleration may be calculated using different time or minutiae windows as well.

Figure 3:
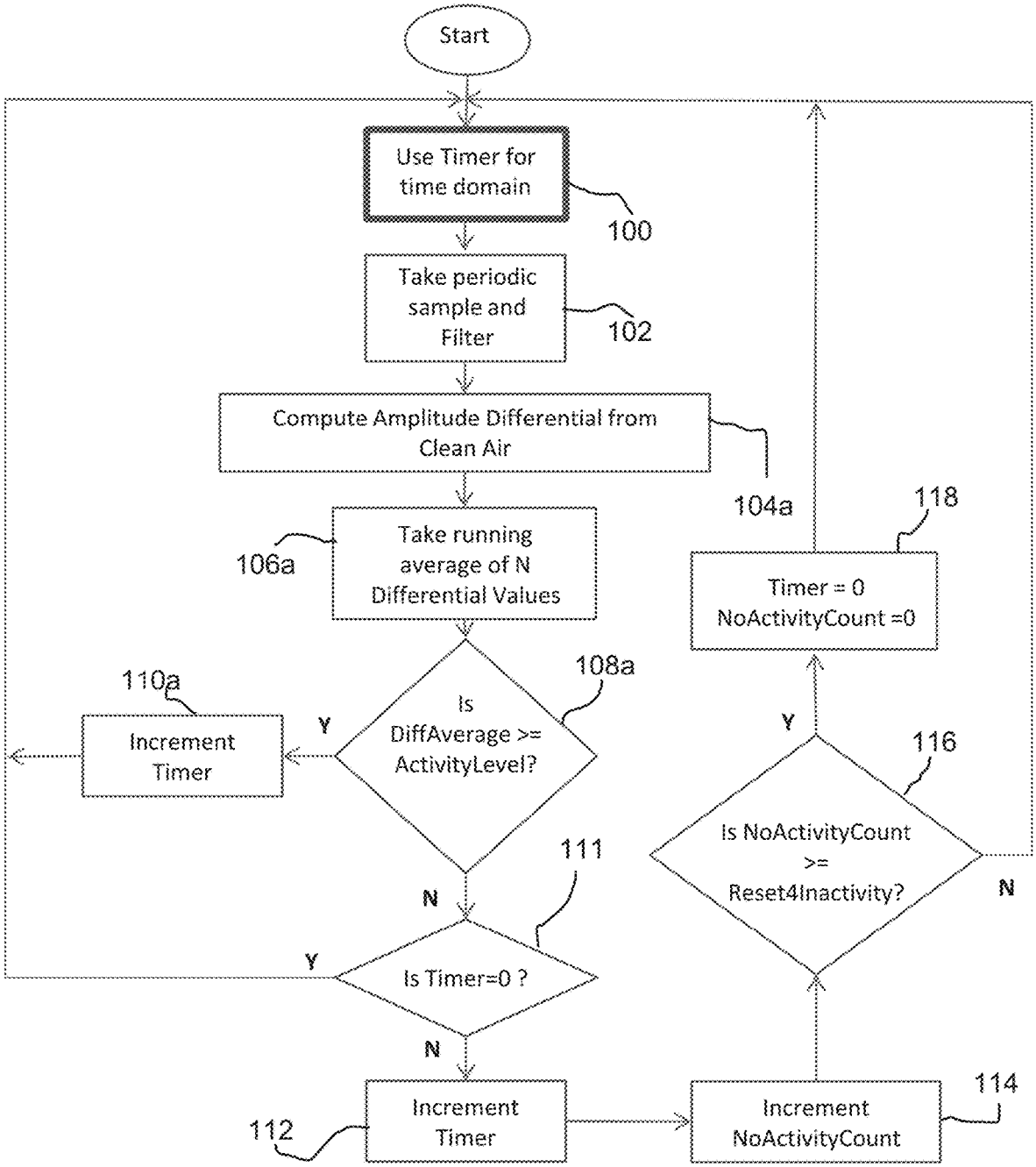
FIG. 3 shows steps in an example method for starting a timer by using an amplitude shift in a detected signal.
Figure 4:
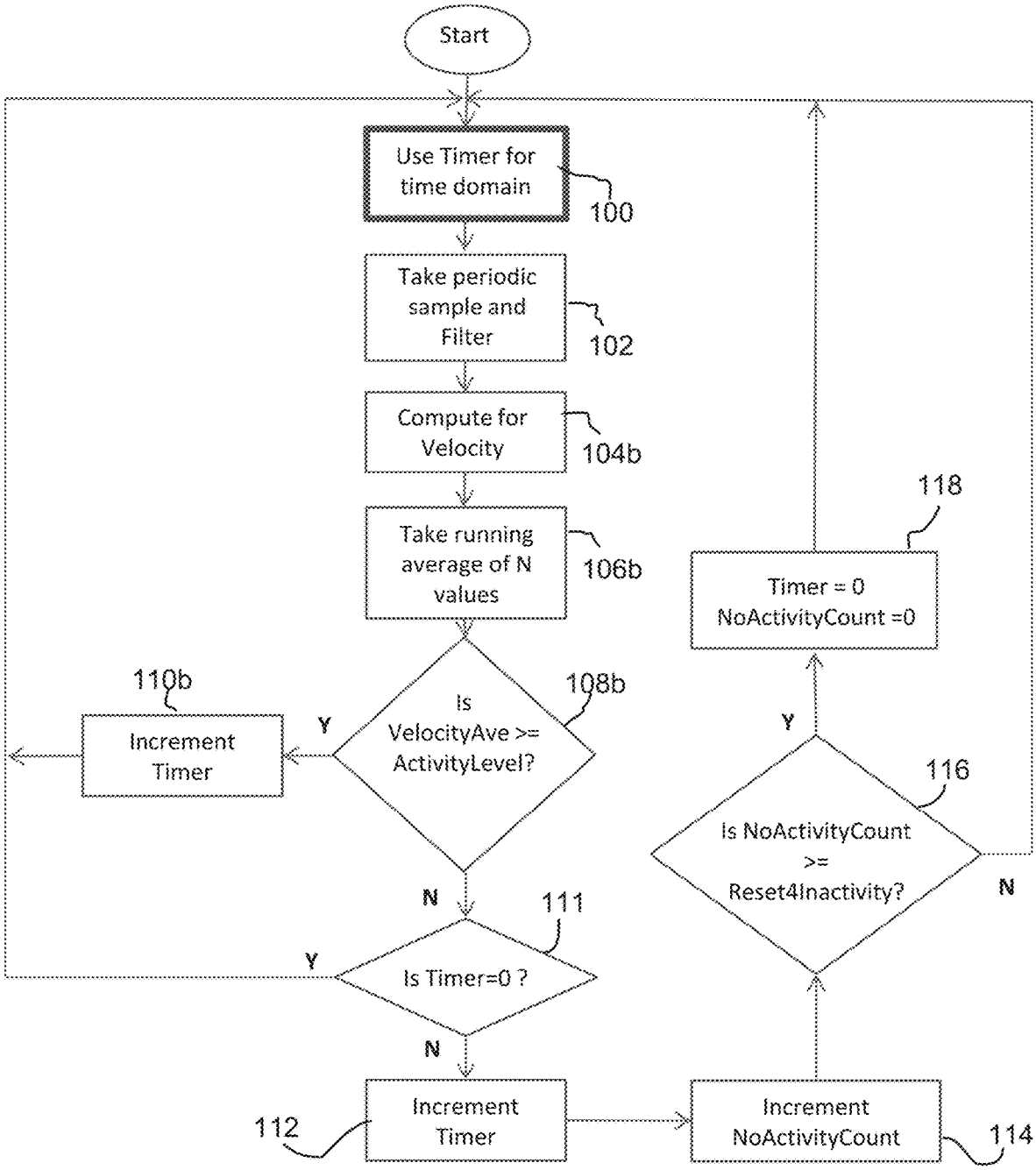
FIG. 4 shows steps in an example method for starting a timer by using velocity in a detected signal.
Figure 5:
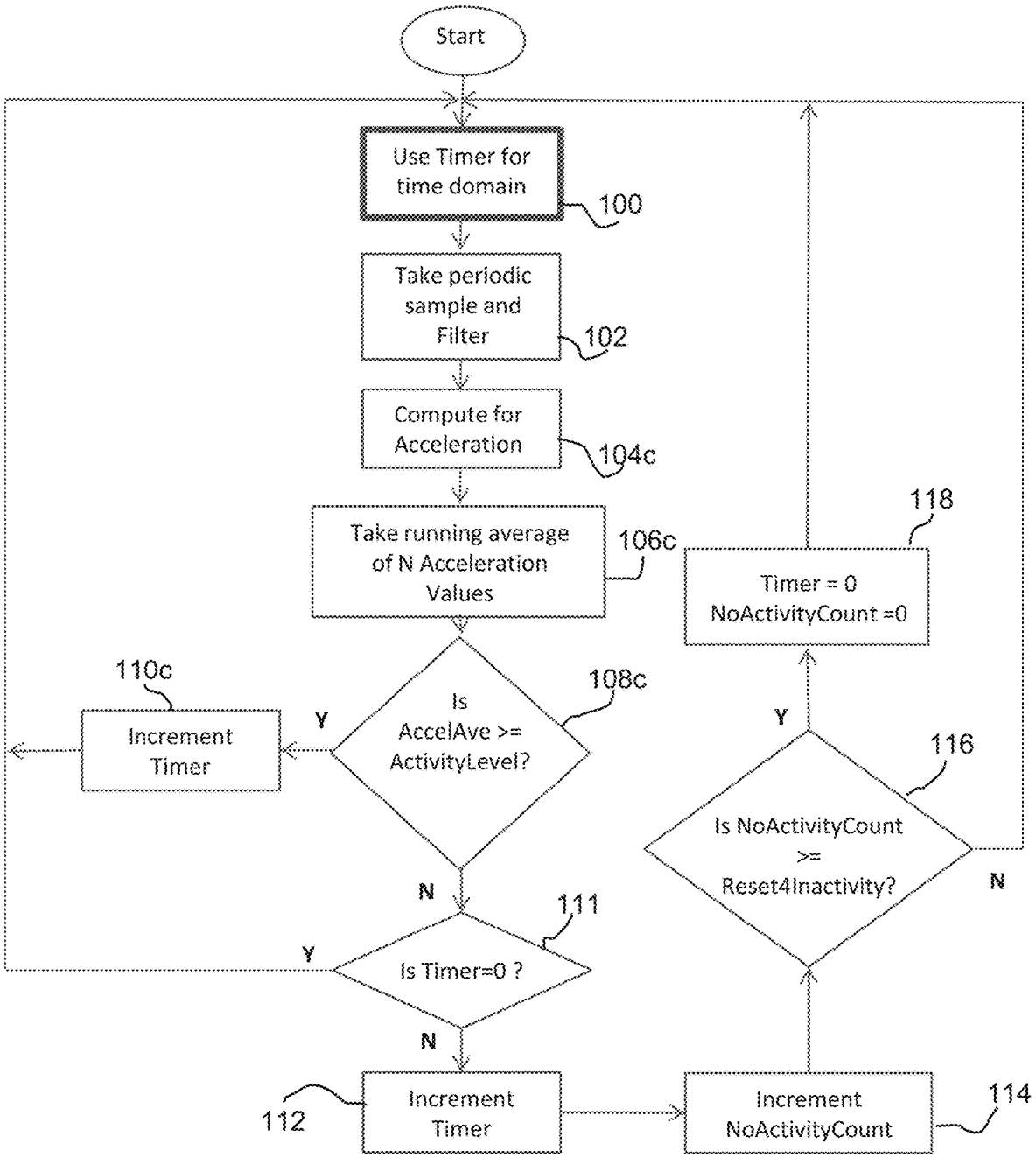
FIG. 5 shows steps in an example method for starting a timer by using acceleration in a detected signal.

Referring now to FIGS. 3-5, in an example method, the ripple detector start/reset timer block module 54 uses any of the minutiae parameters, including amplitude, velocity, or acceleration (averages included) determined by the minutiae computer module 52 to start a timer. The start of the timer determines or triggers a time window or ripple loop within which smoke-fire characterization takes place. Time is measured from a (preferably predefined) starting minutiae point to another (preferably predefined) ending minutiae point. The smoke-fire characterization can take place, for instance, after every ending minutiae point.

To detect the start of the timer, consistent changes in minutiae are monitored to improve prediction. In example methods, the ripple detector start/reset timer block module 54 can:

- Monitor signal amplitude (e.g., absolute signal amplitude, or amplitude differential from clean air) (or its average) and detect if it has changed continuously over a period of time and start the timer (e.g., as shown in FIG. 3), or
- Monitor signal velocity (or its average) and detect if it has changed continuously over a period of time and start the timer (e.g., as shown in FIG. 4), or
- Monitor signal acceleration (or its average) and detect if it has changed continuously over a period of time and start the timer (e.g., as shown in FIG. 5).

Example averages that may be used for minutiae based on averages include, but are not limited to:

- A running average of the last n (e.g., 10, though this number can be greater or fewer) readings, spaced at a particular time interval. A particular nonlimiting example average of 10 readings of velocity, spaced 10 seconds apart can be used to detect a ripple that starts the timer.
- Average acceleration, to further characterize the smoke/fire.

This average acceleration can be computed from the start of the timer (Timer=0) up to the point when the minutiae reference is detected. In another example, the average acceleration can be measured from a timer's predefined starting minutiae point to the timer's predefined ending minutiae point. For example, a minutiae reference for Ion detection technology can be Amplitude. For Photo detection, the minutiae reference can be the running average of the velocity. Other minutiae reference and methods for calculating average acceleration can alternatively or additionally be used.

In each of these example methods the timer is used to provide a time domain 100, and periodic (or continuous) samples of signals from the smoke sensor 28 are acquired and filtered 102 (e.g., by the filter module 50). Nonlimiting example sampling methods for acquiring the samples from the smoke sensor 28 include:

- Sampling at times T1, T2, T3, . . . Tn: In this example method, the sampling times may be, but need not be, periodic. Sampling times T1 to Tn can be determined, for instance, empirically from actual fire run data (e.g., taken from known measurements), or in other ways. As opposed to a window of time sampling, this example sampling uses a fixed point of time when one samples the minutiae and compares them with a range of values (e.g., greater or less than). The respective fires can be scored accordingly based on the minutiae values.
- Sampling using reference minutiae at sample points P1, P2, P3, . . . Pn: One or more reference minutiae can be selected empirically based on actual fire run data, or in other ways. As a nonlimiting example, for an ion detector, one or more reference amplitudes can be used as reference minutiae. When a reference amplitude is reached, evaluation of time (if it is within a certain window of time) and other minutiae and averages are evaluated. In an example embodiment, the average acceleration is used to further enhance prediction, though other minutiae can alternatively or additionally be used.

The filtered samples from the acquiring and filtering 102 are evaluated by the minutiae computer module 52 to compute amplitude, such as amplitude differential from clean air (FIG. 3, step 104*a*), velocity, such as velocity of a signal profile (FIG. 4, step 104*b*), and/or acceleration, such as acceleration of a signal profile (FIG. 5, step 104*c*). The computed amplitude, velocity and/or acceleration is monitored by the ripple detector start/reset timer block module 54 to determine whether the timer is started, incremented, or reset.

In the example monitoring method shown in FIG. 3, the ripple detector start/reset timer block module 54 determines a running average (DiffAverage) of N differential values 106*a*, where N can be selected as described above. Next, it is determined whether the differential average is greater than or equal to an activity level (ActivityLevel) 108*a*, which can be selected based on an observed amplitude value indicating presence of fire incident. If the differential average reaches the activity level, the timer is incremented 110*a*, and the process returns to step 100 for acquiring additional samples. If not, it is then determined whether the timer equals zero 111; that is, to find out whether the timer had initially started and requires a reset. If the timer equals zero, the process returns to step 100 (without the timer being incremented).

Similarly, in the example monitoring process in FIG. 4, based on the velocity computation 104*b*, the ripple detector start/reset timer block module 54 determines a running average (VelocityAve) of N velocity values 106*b*, where the velocity represents the slope or rate of rise of the signal amplitude, and where N can be selected as described above. Next, it is determined whether the velocity average is greater than or equal to an activity level (ActivityLevel) 108*b*, which level can be selected based on observed velocity value indicating presence of fire incident. If the differential average reaches the activity level, the timer is incremented 110*b*, and the process returns to step 100 for acquiring additional samples. If not, it is then determined whether the timer equals zero; that is, to find out whether the timer had initially started and requires a reset. If the timer equals zero, the process returns to step 100 (without the timer being incremented).

In the example monitoring process in FIG. 5 based on the acceleration computation 104*c*, the ripple detector start/reset timer block module 54 determines a running average (AccelAve) of N acceleration values 106*c* representing the acceleration of the signal amplitude, and where N can be selected as described above. Next, it is determined whether the acceleration average is greater than or equal to an activity level (ActivityLevel) 108*c*, which level can be selected based on observed acceleration values indicating presence of fire incident. If the differential average reaches the activity level, the timer is incremented 110*c*, and the process returns to step 100 for acquiring additional samples. If not, it is then determined whether the timer equals zero; that is, to find out whether the timer had initially started and requires reset. If the timer equals zero, the process returns to step 100 (without the timer being incremented).

In each of the example monitoring methods in FIGS. 3-5, the timer can be reset after a certain time of inactivity. For example, if the timer does not equal zero, the timer is incremented 112 and a no-activity counter (NoActivity-Count) is incremented 114. The ripple detector start/reset timer block module 54 then determines whether the no-activity counter reaches a reset threshold (Reset4Inactivity) 116. If so, the timer is reset to zero along with the no-activity counter 118. If not, the process returns to step 100.

Schedule/minutia analyzer 56 evaluates minutiae sets at one or more sampling times or points. Minutiae sets are evaluated either in time at T1, T2, T3, . . . Tn as described above or at a window of time where minutiae reference points P1, P2, P3, . . . Pn occur. Sampling times T1 thru Tn or P1 thru Pn are defined by the SamplePoint(n) values stored in memory 42. In each sampling time or point, each minutia computed by minutia computer 52 is compared with a range of parameters also stored in memory 42. Each sampling time or point evaluation increases or decreases the probability of each fire being characterized.

Once all predetermined sample times/points are evaluated during a fire incident, the scheduler/minutia analyzer and fire type probability analyzer module 56 then compares the final computed probabilities for each smoke type and determines or assesses the smoke or fire type based on the highest computed probability.

In an example method, the parameters are selected to characterize and output scores or probabilities for each of various predetermined smoke or fire types, e.g., types 1 . . . Y, based on signatures, particularly minutiae signatures. Parameters for the signatures can be determined, for example, by determining minutiae from previous smoke or fire signal profiles, or by training the scheduler/minutiae analyzer and fire type probability analyzer module 56 using previous or current minutiae.

Figure 6:
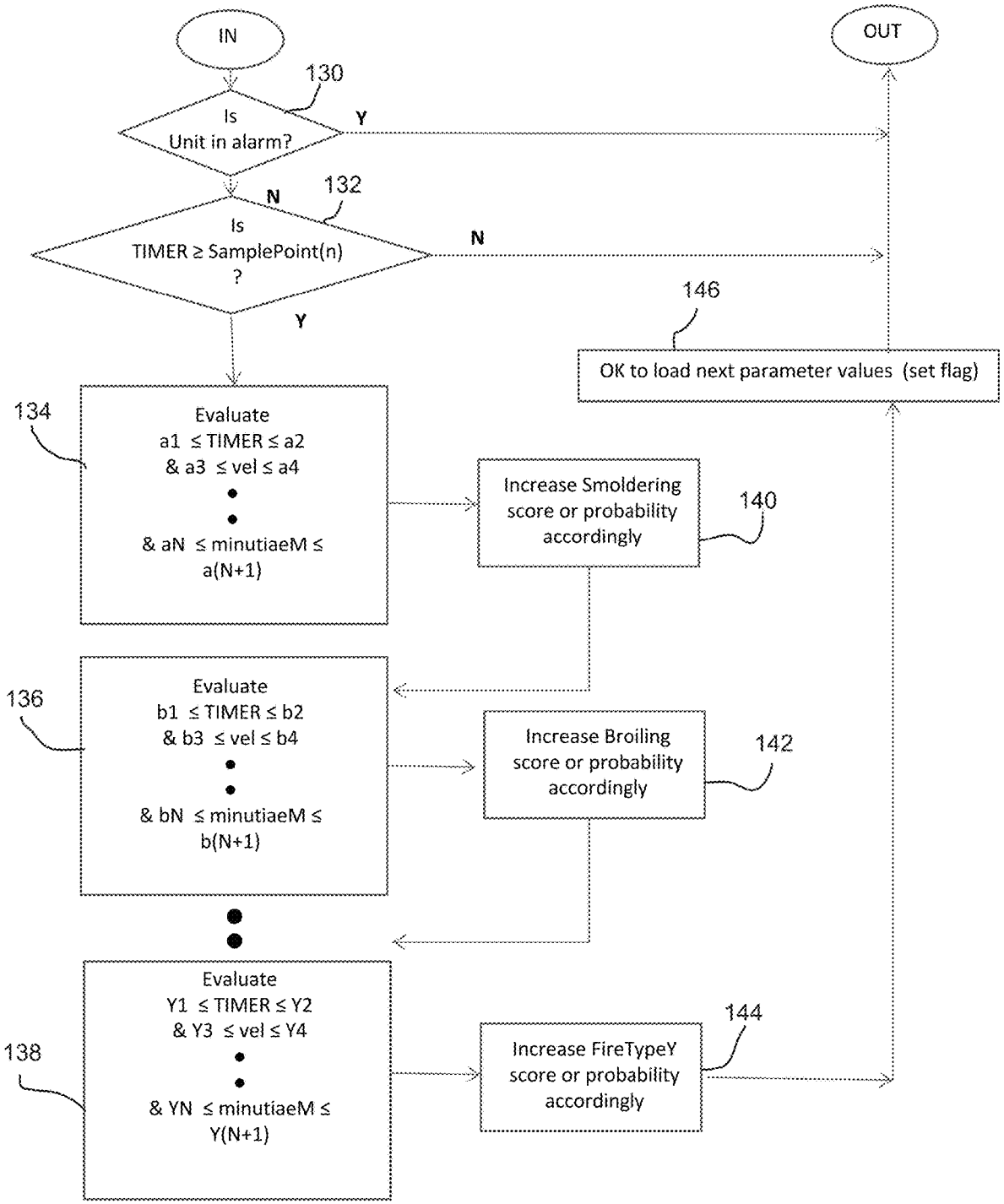
FIG. 6 shows an example method for smoke-fire characterization using time as a reference.

In a particular example training method, all minutiae computed values from the minutiae computer module 52 are output serially to a computer, which can include the detection circuit 40 or a separate computer, while test fires (e.g., UL fires) are being performed. From the data, the detection circuit 40 or other computer can empirically obtain the corresponding ranges for each minutia that best describe the fire being run, referred to herein as minutiae range. These minutiae range can then be utilized by the detection circuit 40 in subsequent operations to identify the type of smoke or fire. In FIG. 6, ranges a1 thru a2, a3 thru a4, etc. are examples of minutiae ranges where values of acceleration and velocity respectively are likely to occur in a smoldering fire. A score or probability for a smoldering fire can be increased, e.g., from a default sensitivity (such as "medium" or other sensitivity) if the computed minutiae are found inside the minutiae ranges.

FIG. 6 shows an example method for smoke-fire characterization of types 1 . . . Y using time as a reference sample point. It will be appreciated that the particular characterizations and signatures shown are merely exemplary. Given computed minutiae, the alarm level detector module 60 determines whether an alarm condition is present 130, for instance by comparing the computed minutiae to one or more thresholds set by default or previous set during an operation of the detection circuit 40. If it is determined that the alarm condition is present, (e.g., alarm signal, or alarm indicator) it is understood that smoke-fire characterization is already completed and no longer necessary and is exited.

If an alarm condition is not present, the scheduler/minutiae analyzer and fire type probability analyzer module 56 then determines whether the current sample point is reached 132 given the time window set by the ripple detector start/reset time block module 54. If the current sample point has not yet occurred, the minutiae computer module 52 determines additional minutiae. If the sample point is detected, as can be indicated by the current timer reaching a set timer reference value (SamplePoint(n)), the parameters provided by the minutiae computer module 52 are then compared to one or more, and preferably a plurality of, minutiae ranges for respective smoke or fire characterizations. In FIG. 6, example minutiae ranges are provided for smoldering type fire 134, broiling type fire 136, and Fire type Y 138. If the parameters (e.g., acceleration, velocity, . . . minutiaeM) fall within the smoldering fire type minutiae ranges 134, the smoldering fire type score or probability is increased 140. If, instead, the parameters fall within the broiling fire type signature 136, the broiling fire type score or probability is increased 142. Additional fire/smoke type minutia ranges are used to evaluate other fires up to Fire type Y 138. If the parameters fall within the signature for Fire type Y, the score or probability for Fire type Y is increased 144. Otherwise, the scores or probabilities for the various predetermined fire types are maintained for this time window. Once a sampling time is reached (SamplePoint(n)), a flag is set 146 so a new SamplePoint(n) and set of minutiae parameter ranges can be loaded from memory 42 to start for the next sample time evaluation. In this way, smoke/fire characterizations are performed for each of multiple sampling times, and in each sampling time probabilities for one of a plurality of predetermined types of smoke/fire can be increased.

Figure 7:
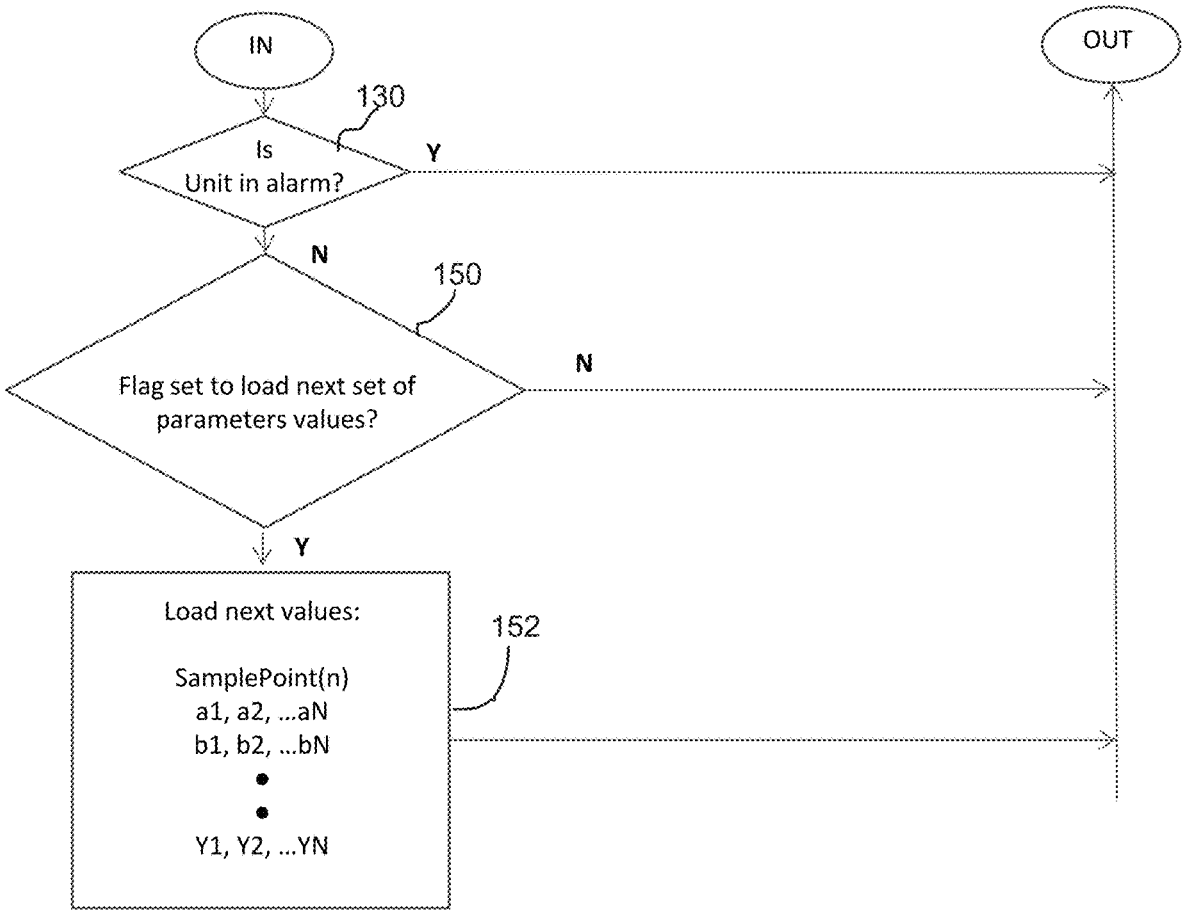
FIG. 7 shows an example method for loading parameters for a next window of time analysis, using time.

FIG. 7 shows an example method for loading minutiae parameters ranges, e.g., from the memory 42, for the next sampling time analysis after the previous analysis is completed. If it is determined 130 based on the computed minutiae that the unit is not in alarm; that is, the alarm level detector module 60 has not determined an alarm condition, the fire type probability analyzer module 56 then determines whether the previous sampling time has been completed 150, e.g., whether a flag was set to load a next set of parameters values. If not, a new set of minutiae parameter ranges are not loaded. If the previous sampling time has been completed, the next values for each of the minutiae corresponding to the parameters to be evaluated are loaded from the memory 42, as well as the new SamplePoint(n).

Figure 8:
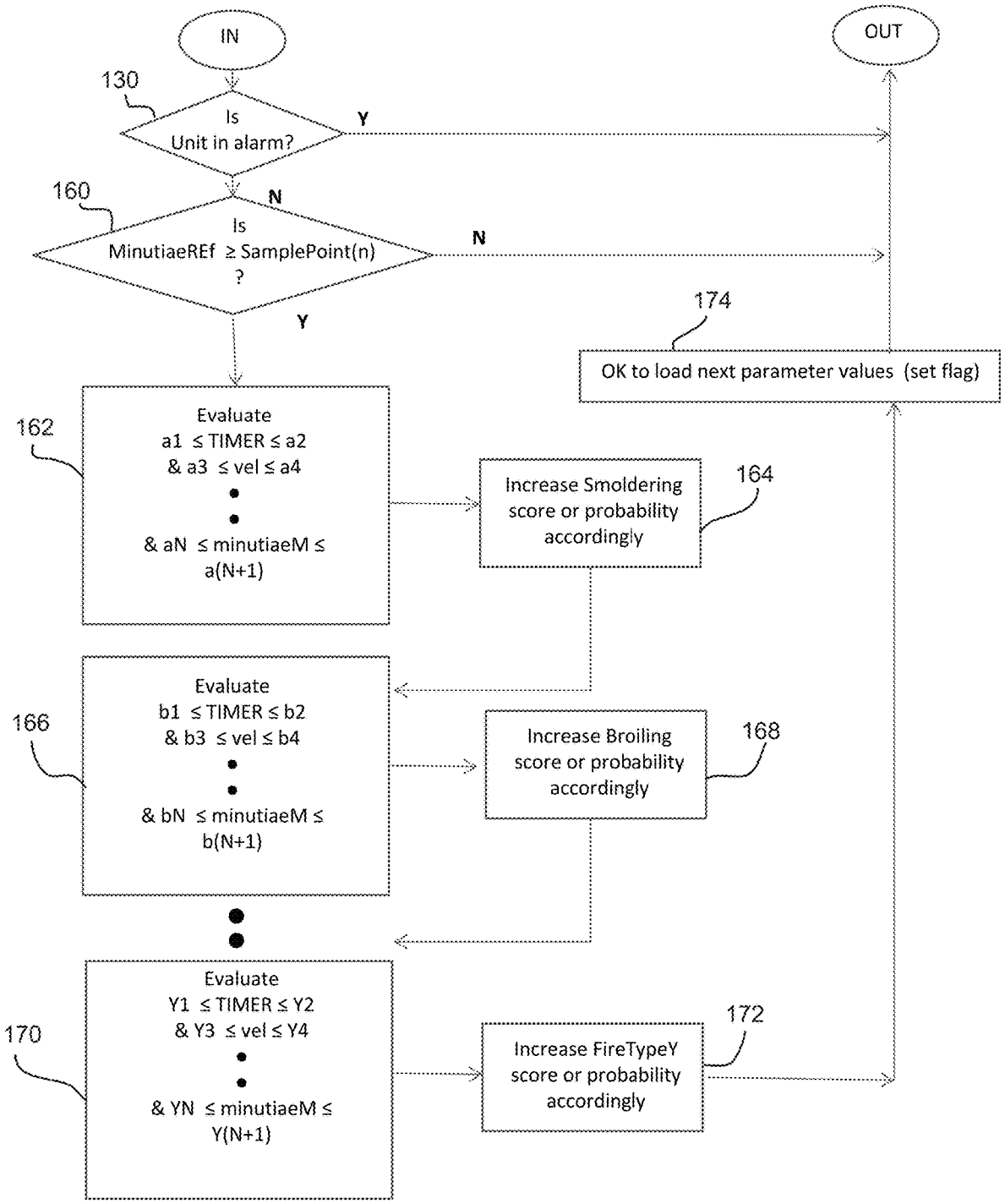
FIG. 8 shows an example method for smoke-fire characterization using minutiae as a reference.

FIG. 8 shows an alternative example method for smoke-fire characterization of types 1 . . . Y using any other minutiae as a reference for determining a smoke-fire characterization sampling point as opposed to purely measuring time (though in the method of FIG. 8, time itself can be an example of the minutiae). If the unit is not in alarm 130, the particular reference minutiae used (referred to herein as a minutiae pointer) is compared to a reference value (SamplePoint(n)) 160. If the minutiae pointer has not reached the reference value, the minutiae computer module continues determining minutiae values.

If the minutiae pointer has reached the reference value, the fire type probability analyzer module begins characterizing the smoke-fire type. In the example method of FIGS. 6 and 8, the timer can also be considered by detecting if its value is within its corresponding minutiae sampling range provided at the time of analysis. The Timer value is used with other minutiae for comparing to parameters of one or more signatures. For instance, to determine whether the minutiae corresponds to a smoldering type fire 162, the TIMER value as well as other minutiae are compared to the parameters for the smoldering fire signature. If the minutiae corresponds, the smoldering fire type probability or score is increased 164. Similar characterizations can be made for broiling type fire 166, resulting in a broiling fire type score or probability being increased 168, for a characterization of Fire type Y 170, resulting in a Fire type Y score being increased 172. After the corresponding score(s) have been increased, next values for each of the minutiae corresponding to the parameters to be evaluated are loaded from the memory 42, as well as the new SamplePoint(n) 174.

Figure 9:
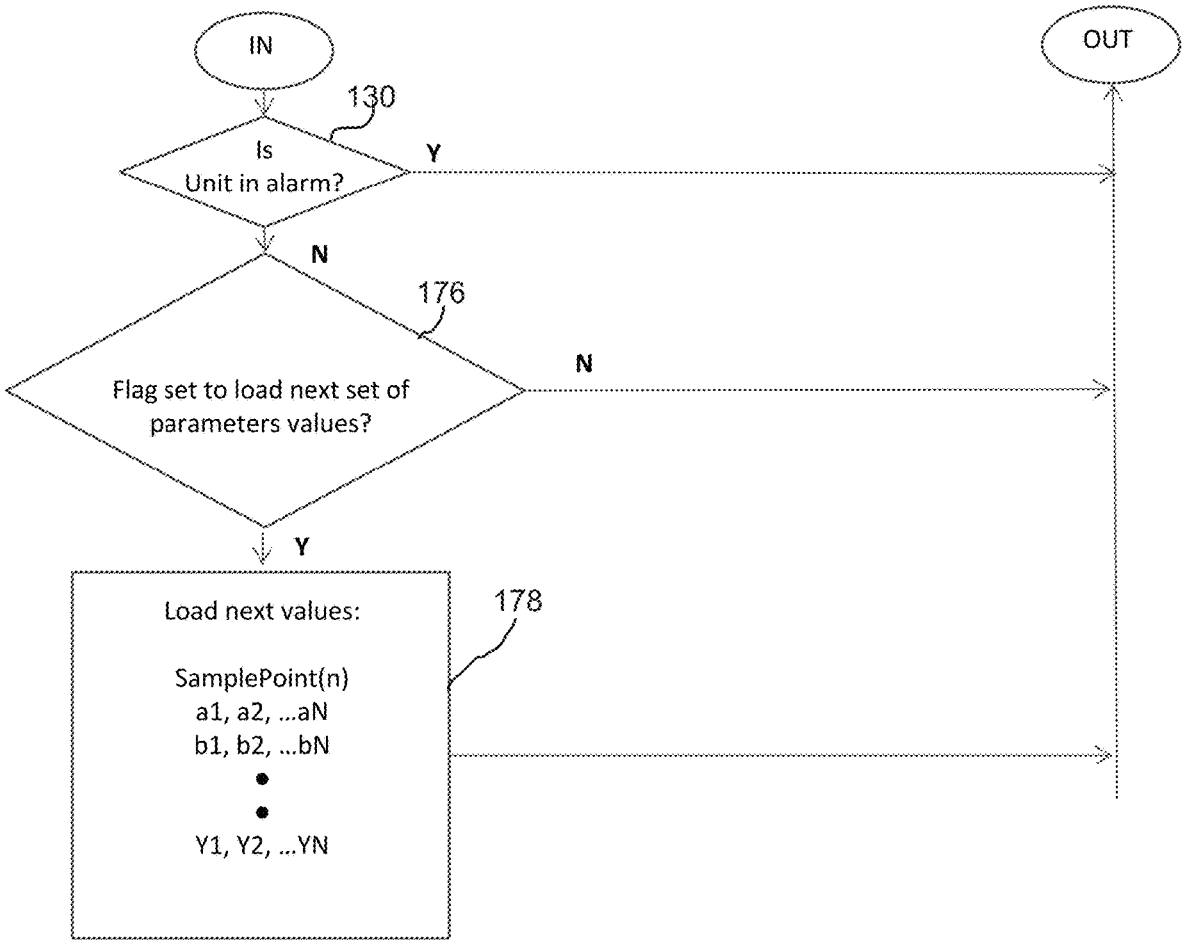
FIG. 9 shows an example method for loading parameters for a next window of time analysis, using minutiae.

FIG. 9 shows an example method for loading parameters, e.g., from the memory 42, for the next window of time analysis using minutiae after the previous sampling point analysis is completed. Again, if it is determined that the smoke device already is in alarm mode 130, the smoke-fire characterization can be bypassed, and an alarm state output by the alarm 30. If not, it is determined whether a previous sampling point analysis is completed, e.g., whether a flag was set to load a next set of parameters values 176. If the previous sampling point has not occurred, the previous window of time analysis continues. If the previous sampling point analysis has been completed, the next parameter values are loaded 178 from the memory 42, including the new SamplePoint(n) value along with the other minutiae ranges used to compare to parameters of signatures.

FIG. 10 shows an example method for updating or adjusting alarm parameters. The alarm level detector module 60 may again determine whether an alarm condition is present 130, and if so, the detection circuit 40 bypasses the updating process and signals an alarm. If an alarm condition is not present, it is determined whether the last nth sample point has been completed 180. If the last nth sample point has not been completed, additional characterization is performed. If the last nth sample point has been completed, the fire type and alarm levels selector module 58 analyzes which smoke or fire type has the highest score 181 given the output of the minutiae analyzer and fire type probability analyzer module 54.

Given this determination, the alarm levels for each of amplitude, slope, and acceleration (or any one, or two, or three of these) are set to an alarm level (threshold level) corresponding to the characterized smoke or fire type. For instance, if the fire type and alarm levels selector module 58 determines that smoldering type is highest 182, the amplitude (AmplitudeAlarm), slope (SlopeAlarm), and acceleration (AccelerationAlarm) alarm levels can be set to thresholds corresponding to threshold levels of these minutiae for a smoldering type 184 (e.g., AmpSmolderAlarm, SlopeSmolderAlarm, AccelSmolderAlarm). Similarly, if the fire type and alarm levels selector module 58 determines that broiling type is highest 186, or a Fire Type N is highest 188, the amplitude (AmplitudeAlarm), slope (SlopeAlarm), and acceleration (AccelerationAlarm) alarm levels can be set to thresholds corresponding to threshold levels of these minutiae for a broiling type 190 (e.g., AmpBroilAlarm, SlopeBroilAlarm, AccelBroilAlarm) or for Fire type N 192 (e.g., AmpFireTypeNAlarm, SlopeFireTypeNAlarm, AccelFireTypeNAlarm), respectively. If it is determined that no fire type through firetypeN has a highest score, the threshold levels are not changed.

The alarm levels can be determined by, for instance, empirically using data obtained from a fire room, e.g., a UL fire room, or running of actual fires. Alarm levels can be stored in the memory 42 and accessed by the processor. In an example method, when any score of any fire is changed, the highest scoring fire is selected and its corresponding alarms (amplitude, velocity, and/or acceleration) are loaded for alarm monitoring. However, it is also possible that more than one higher-scoring fire can be selected, and the alarms loaded based on, for instance, adjustments that are weighted according to the determined scores.

In an example method for determining an alarm condition 130, if the alarm level detector module 60 detects that particular minutiae (amplitude, velocity, acceleration, etc., or any one, or two, or three of these, and/or any averages) reaches or exceeds the level of the set threshold(s), which are set based on the characterized smoke or fire type, the alarm level detector module outputs a signal over a suitable wired or wireless connection to the alarm 30 to activate the alarm. It is not necessary for the same minutiae to be used to both characterize the smoke or fire and to detect an alarm condition 130, though it is possible. As a nonlimiting example, an average acceleration may be used to further characterize a smoke or fire, while a computed non-averaged acceleration, non-averaged velocity, and/or non-averaged amplitude can be used to trigger the alarm. It will be appreciated that many combinations of minutiae for characterizing smoke or fire and for detecting an alarm condition are possible, and all such combinations are contemplated under embodiments of the present invention.

Activating the alarm 30 can include, but is not limited to, emitting sound and/or visual (e.g., light) signals, e.g., using the horn 32 or the LED 34, as will be appreciated by those of ordinary skill in the art. Alternatively or additionally, activating the alarm can include the alarm level detector module 60 (directly or via the alarm 30) communicating via a suitable signal the alarm condition to external devices, such as connected smoke devices in a network, remote or local control or security systems, servers, radios, emergency vehicles, etc. Those of ordinary skill in the art will appreciate that other methods for activating the alarm 30 are possible.

Figure 11:
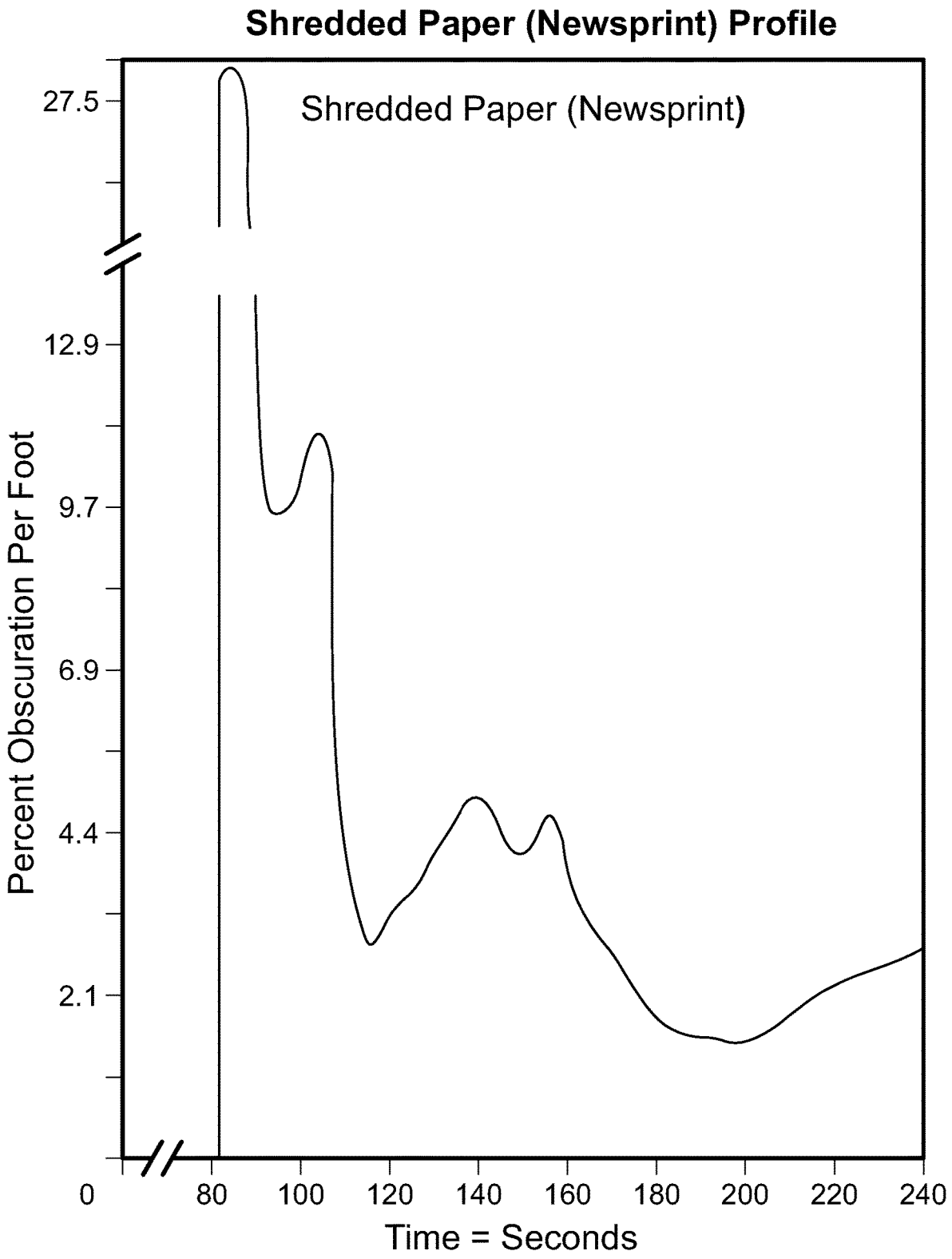
FIG. 11 shows an example detected signal profile for shredded paper (newsprint)

In example methods, as long as an alarm level is not reached, the analysis of minutiae and fire-smoke characterization can continue to improve accuracy of prediction. For example, paper and wood crib fires evaluated by UL have the same initial slopes at almost the same window of time. FIG. 11 shows an example profile for shredded paper (newsprint). However, the paper fire produces low level signals than the wood crib; particularly, the signal amplitude of paper fire is lower than the wood crib. With conventional detection methods, the paper fire is not readily detected by, say, an ionization sensor because of its low amplitude signal. With example detection methods provided herein, if one can identify the paper fire, one can set the amplitude alarm threshold to become more sensitive. In an example method, each minutiae increases the score of the fire by a certain amount if they are found to be within the expected range. If the first point or time analysis could not discern between the two fires, additional analysis can be made. This is done by analyzing the next minutiae point of interest.

Figure 12:
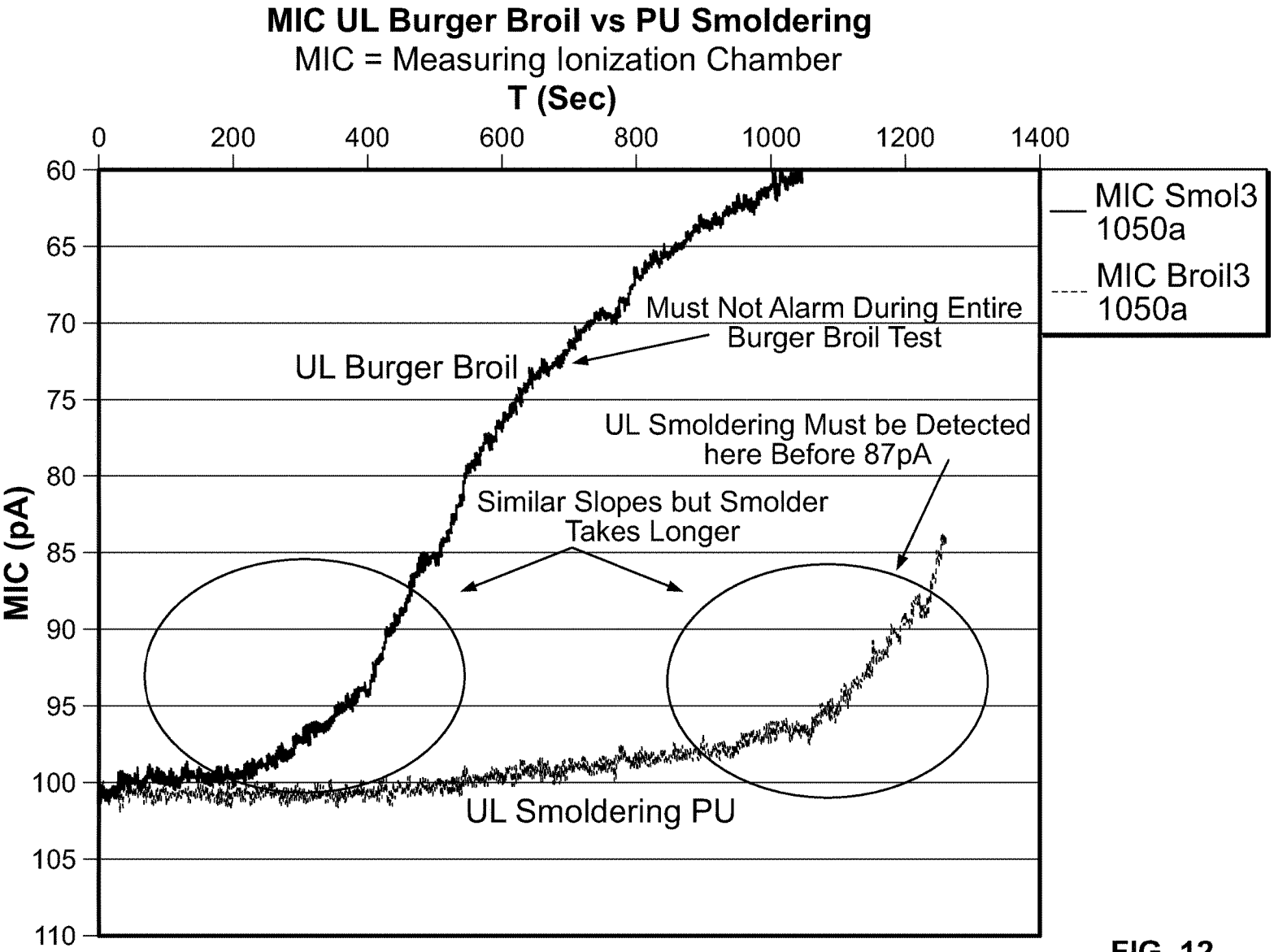
FIG. 12 shows example detected signal profiles for MIC UL Burger Broil versus PU Smoldering.

As another example, FIG. 12 shows two measuring ionization chamber (MIC) profiles for UL Burger Broil and UL PU Smoldering. Both the Burger Broil and the PU Smoldering profiles have areas with similar slopes (and amplitudes). However, the PU Smoldering profile takes longer to reach this slope (that is, the slope occurs within a later time window). If only an amplitude or slope is considered, signals according to the Burger Broil profile could create a (false) alarm condition, and could potentially cause a user to deactivate the alarm. Accordingly, under recently added fire tests, an alarm should not alarm during the entire Burger Broil test; i.e., during the entire Burger Broil profile. Under this scenario, it is possible that the alarm would be deactivated before the Smoldering PU fire is detected. By changing the sample point or time according to example methods, and by characterizing the Burger Broil and the Smoldering PU based on computed minutiae, the smoke device of example embodiments can avoid the false alarm due to the Burger Broil and determine that an alarm level has been reached as a result of the Smoldering PU.

Figure 13:
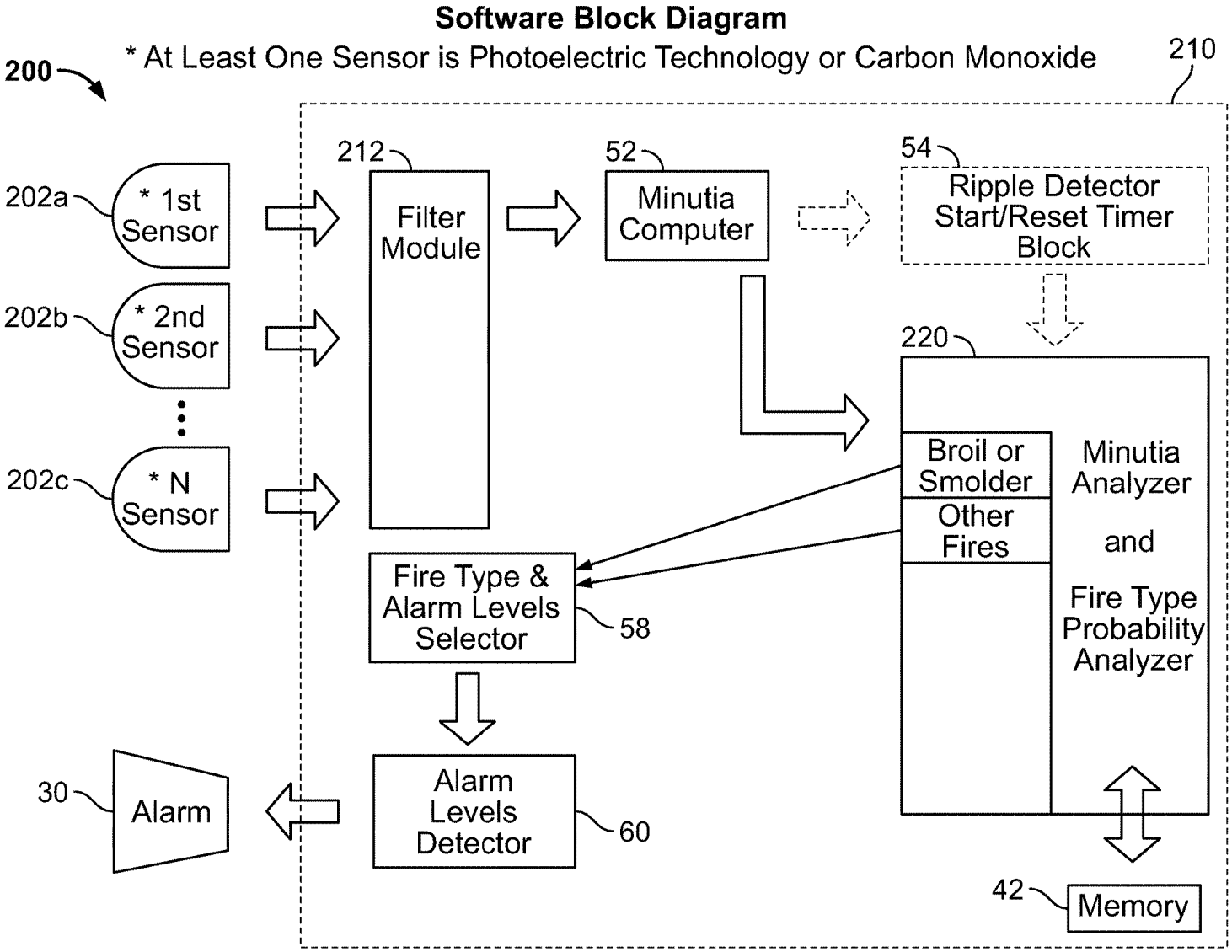
FIG. 13 shows components of a multi-sensor smoke device according to another embodiment of the invention.

FIG. 13 shows components of a multi-sensor smoke device 200 according to another embodiment of the invention. The multi-sensor smoke device 200 may be embodied in a smoke detector, a smoke alarm, and/or in a fire panel connected to multiple smoke detectors. The multi-sensor smoke device may have a housing 24 similar to the smoke detector 20 shown in FIG. 1A or a housing similar to the smoke alarm 22 in FIG. 1B, as non-limiting examples, or have a different housing.

Example features of the multi-sensor smoke device 200 can be generally similar to those shown in FIG. 2A, and like or similar features are described elsewhere herein. However, the example multi-sensor smoke device 200 includes multiple smoke sensors 1 . . . N (202*a*, 202*b*, 202*c*). At least one of the smoke sensors, e.g., sensor 202*a*, is selected and/or configured to detect smoldering fire, and at least one or more, e.g., sensor 202*b*, is selected and/or configured to detect fast flaming fire. Preferably, at least one of the sensors 1 . . . N is an infrared photoelectric sensor (e.g., an IR photo diode) or a carbon monoxide (CO) sensor. Example groups of sensors for the smoke sensors 202*a*, 202*b*, 202*c* include, but are not limited to:

Infrared (IR) photoelectric and ionization sensors—IR photoelectric sensor detects large particles (smoldering fire), and ionization sensor detects small particles (fast flaming fires)

Infrared photoelectric and ultraviolet (UV) photoelectric sensors—IR photoelectric sensor detects large particles (smoldering fire), and UV photoelectric sensor detects small particles (fast flaming fires)

Photoelectric, ionization, and carbon monoxide sensors.

An example multi-sensor detection circuit 210 shown in FIG. 13 is generally similar to the detection circuit 40 (FIG. 2A), but includes one or more filter modules 212 coupled to the multiple smoke sensors 1 . . . N 202*a*, 202*b*, 202*c* for receiving signal inputs from the multiple smoke sensors. The use of multiple smoke sensors 1 . . . N allows the detection of both smoldering and fast flaming fires. However, such a configuration can also make the example multi-sensor smoke device 200 very sensitive to, for instance, burger broiling fire or other slow developing cooking fires. Burger broiling produces an abundant quantity of both small and large particles. However, burger broiling is a nuisance fire, and should not cause a smoke device to alarm. To avoid this, a smoke device can be made very insensitive, but this conflicts with the additional requirement to make the product sensitive to detect polyurethane fires.

To address this conflict, the multi-sensor detection circuit 210 in the example multi-sensor smoke device 200 distinguishes any slow progressing fires, such as burger broiling, from other types of fires. If the fire is identified as a slow progressing fire, the alarm threshold sensitivity of the multi-sensor smoke device 200 can be automatically adjusted to become less sensitive (insensitive). Example methods for identifying slow progressing fires include, but are not limited to:

1) Using one or more of the methods described in FIGS. 3-10 above for identifying fires, where the time from when fire started information (fire start time information) is used; or
2) Identifying the fire without the use of fire start time information, and merely tracking at least one of the above minutiae. For example, the velocity of a slow moving fire is low. The amplitude change per time is also low (although this is also velocity). When a low velocity or amplitude is detected, the alarm threshold can be made insensitive. Conversely, the alarm threshold can be made insensitive in normal mode. If the computed minutiae predicts a fast fire (i.e., not burger or not smolder) then the alarm threshold can be automatically adjusted to become more sensitive.

For example, in the example multi-sensor smoke device 200, the ripple detector start/reset timer block module 54 can be incorporated if a fire detection method according to example 1) above is used, or omitted if a fire detection method according to example 2) above is used. A minutia analyzer and fire type probability analyzer 220 can be provided in place of the scheduler/minutia analyzer and fire type probability analyzer 56 shown in FIG. 2A. Further, the example minutia analyzer and fire type probability analyzer 220 can be configured to analyze a probability that the fire type is either "broil or smolder," indicating a slow progressing fire, or "other," and the result of this probability analysis can provided to the fire type and alarm levels selector module 58. The fire type and alarm levels selector module 58 can be configured to operate as described above.

The example multi-sensor smoke device 200 accounts for the concern that a smoldering fire, which must generate an alarm, will also be detected as a slow fire, and thus equivalent to a burger broil with a corresponding insensitive alarm limit. By including at least an infrared photoelectric sensor (e.g., an IR photo diode) or a CO sensor among the smoke sensors 1 . . . N, a signal provided by such smoke sensors in response to a smoldering fire will be higher than that for burger broiling. Further, the new, less sensitive (e.g., insensitive) alarm threshold that is set upon detecting burger broiling is made low enough to still ensure detection of smoldering fires. As used herein, "insensitive" refers to an alarm level that is set so as not to alarm below 1.5% per foot obscuration when tested in a fire room.

Any of the above example methods can also be provided by a fire panel (not shown) connected to multiple smoke detectors 20 or multiple smoke sensors 28, which may be, but need not be, embodied in conventional smoke detector housings. In an example embodiment, the fire panel collects all information from the smoke sensors 28 that are scattered throughout a building location, and performs computations locally using the fire panel's microprocessor and memory. For instance, the fire panel may include the modules in the detection circuits 40, 210 shown in FIG. 2A or FIG. 13, and these modules can be in signal communication (wired or wireless) with the smoke detectors 20 or smoke sensors 28. Additionally or alternatively, the fire panel may include the alarm 39 and any one or more of the modules in the detection circuits 40, 210 (as a nonlimiting example, the alarm level detector 60 and the fire type and alarm levels selector 58), and these modules can be in signal communication (wired or wireless) with any one or more of the remaining modules in the detection circuits 40, 210, along with, for instance, smoke sensors 28.

Example smoke devices, systems, and methods have been disclosed herein, which may have one or several advantages. For instance, example methods can better determine a point in time that a smoke or fire started. This 'origin' can be used to establish the time domain for probability computation. Example methods can use a time parameter to evaluate multiple minutiae characteristics of the smoke-fire signal, and thus significantly improve characterization of the smoke-fire. In such methods, a timer can be restarted if there is no smoke-fire activity.

Example devices, methods, and systems can evaluate average amplitude, average velocity, and average acceleration for improving consistency of prediction. Further, example devices, methods, and systems can analyze several or all minutiae characteristics of a smoke or fire signal in multiple windows of time. Such example methods can completely or nearly completely distinguish between different smoke and fire signal profiles.

Example detection circuits 40, 210 provided herein can dynamically change alarm thresholds based on the identified smoke-fire type. Such multiple alarm thresholds can be based on corresponding minutiae characteristics. The detection circuits 40, 210 can then activate, once a smoke-fire type has been identified, an alarm when any of various values are reached (e.g., amplitude threshold, slope threshold, acceleration threshold, average slope threshold, average acceleration threshold, etc.). Further, using the multiple-sensor detection circuit 210 with multiple sensors 202*a*, 202*b*, 202*c* facilitates detecting both smoldering fire and fast flaming fire.

Example embodiments of the invention provide, among, other things, a detection circuit embodied in one or more processors for monitoring a location. The detection circuit comprises: a minutiae computer module configured for receiving signals from a smoke sensor and determining one or more minutiae from the received signals; a ripple detector start/reset timer module configured for receiving at least one of the determined one or more minutiae and determining at least a start time for evaluating one or more of the one or more minutiae; a scheduler/minutia analyzer and fire type probability analyzer module configured for evaluating the one or more of the determined one or more minutiae and characterizing the one or more of the one or more minutiae according to one or more smoke or fire types; a fire type and alarm level selector configured for setting one or more alarm levels based on the characterized one or more smoke or fire types; and an alarm level detector for evaluating at least one minutiae using the set one or more alarm levels and outputting an alarm signal if an alarm condition is determined. An example detection circuit can include any of the above features in this paragraph, wherein the one or more minutiae comprises one or more of signal amplitude, signal velocity, signal acceleration, average signal amplitude, average signal velocity, or average signal acceleration. An example detection circuit can include any of the above features in this paragraph, wherein the signal amplitude comprises one or more of absolute signal amplitude or an amplitude differential; and wherein the signal velocity and signal acceleration are determined from the signal amplitude. An example detection circuit can include any of the above features in this paragraph, wherein the evaluating the one or more minutiae by the scheduler/minutia analyzer and fire type probability analyzer module comprises comparing the one or more of the one or more minutiae to one or more parameters corresponding to characteristics of the one or more smoke or fire types. An example detection circuit can include any of the above features in this paragraph, and further comprise a memory storing the one or more parameters. An example detection circuit can include any of the above features in this paragraph, wherein the scheduler/minutia analyzer and fire type probability analyzer module is configured to access a memory storing the one or more parameters. An example detection circuit can include any of the above features in this paragraph, and further comprise a filter module configured for receiving and filtering the signals from the smoke sensor, wherein the minutiae computer module receives the filtered signals.

An example smoke device according to embodiments of the invention can comprise: a detection circuit according to any of the features of the previous paragraph; a smoke sensor in communication with the minutiae computer module; and an alarm in communication with the alarm level detector. An example smoke device can include any of the features in this paragraph, wherein the processor, the smoke sensor, and the alarm are disposed within a housing. A monitoring system according to embodiments of the invention can include a plurality of smoke devices according to any of the features in this paragraph.

Additional example embodiments of the invention provide, among other things, a method for monitoring a location, comprising: receiving signals from a smoke sensor and determining one or more minutiae from the received signals; receiving the determined one or more minutiae and determining at least a start time for evaluating one or more of the one or more minutiae; evaluating the one or more of the one or more minutiae and characterizing the one or more minutiae according to one or more smoke or fire types; setting one or more alarm levels based on the characterized one or more smoke or fire types; and evaluating at least one minutiae using the set one or more alarm levels and outputting an alarm signal if an alarm condition is determined. An example method can include any of the features in this paragraph, wherein the one or more minutiae comprises one or more of signal amplitude, signal velocity, signal acceleration, average signal amplitude, average signal velocity, or average signal acceleration. An example method can include any of the features in this paragraph, wherein the signal amplitude comprises one or more of absolute signal amplitude or an amplitude differential; and wherein the signal velocity and signal acceleration are determined from the signal amplitude. An example method can include any of the features in this paragraph, wherein the evaluating the one or more minutiae by the scheduler/minutia analyzer and fire type probability analyzer module comprises comparing the one or more of the one or more minutiae to one or more parameters corresponding to characteristics of the one or more smoke or fire types. An example method can include any of the features in this paragraph, wherein the one or more parameters are stored in a memory. An example method can include any of the features in this paragraph, and further comprise: accessing a memory storing the one or more parameters. An example method can include any of the features in this paragraph, and further comprise: filtering the signals from the smoke sensor; wherein the one or more minutiae is determined from the filtered signals. An example method can include any of the features in this paragraph, and further comprises: activating an alarm in response to the output alarm signal.

Additional example embodiments of the invention provide, among other things, a method for monitoring a location performed by one or more processors, the method comprising: receiving signals from a smoke sensor; determining one or more minutiae from the received signals; determining a time window based on some or all of said determined one or more minutiae; characterizing one or more smoke or fire types in the determined time window based on one or more of said determined one or more minutiae; dynamically determining one or more alarm levels based on the characterized one or more smoke or fire types; evaluating at least one of the one or more minutiae in the determined time window using the determined one or more alarm levels; and outputting an alarm signal if an alarm condition is determined.

Additional example embodiments of the invention provide, among other things, a detection circuit embodied in one or more processors for monitoring a location, the detection circuit comprising: a minutiae computer module configured for receiving signals from multiple smoke sensors and determining one or more minutiae from the received signals; a minutia analyzer and fire type probability analyzer module configured for evaluating the one or more of the determined one or more minutiae and distinguishing the one or more of the one or more minutiae as corresponding to either a slow progressing fire type or at least one fire type other than a slow progressing fire type; a fire type and alarm level selector configured for setting one or more alarm levels based on the distinguished slow progressing fire type or the at least one fire type other than the slow progressing fire type; and an alarm level detector for evaluating at least one minutiae using the set one or more alarm levels and outputting an alarm signal if an alarm condition is determined. An example detection circuit can include any of the features in this paragraph, wherein the one or more minutiae comprises one or more of signal amplitude, signal velocity, signal acceleration, average signal amplitude, average signal velocity, or average signal acceleration. An example detection circuit can include any of the features in this paragraph, wherein the signal amplitude comprises one or more of absolute signal amplitude or an amplitude differential; and wherein the signal velocity and signal acceleration are determined from the signal amplitude. An example detection circuit can include any of the features in this paragraph, wherein the evaluating the one or more minutiae by the minutia analyzer and fire type probability analyzer module comprises comparing the one or more of the one or more minutiae to one or more parameters corresponding to characteristics of the progressing fire type or the at least one fire type other than the slow progressing fire type. An example detection circuit can include any of the features in this paragraph, and further comprising: a memory storing the one or more parameters. An example detection circuit can include any of the features in this paragraph, wherein the minutia analyzer and fire type probability analyzer module is configured to access a memory storing the one or more parameters. An example detection circuit can include any of the features in this paragraph, and further comprising: a filter module configured for receiving and filtering the signals from the smoke sensor; wherein said minutiae computer module receives the filtered signals.

Additional example embodiments of the invention provide, among other things, a smoke device comprising: the detection circuit having any of the features of the above paragraph; the multiple smoke sensors in communication with the minutiae computer module; and an alarm in communication with the alarm level detector. An example smoke device can include any of the features in this paragraph, wherein the multiple smoke sensors comprise at least one sensor selected and/or configured to detect smoldering fire, and at least one or more sensors selected and/or configured to detect fast flaming fire. An example smoke device can include any of the features in this paragraph, wherein the multiple smoke sensors comprise an infrared photoelectric sensor and/or a carbon monoxide (CO) sensor. An example smoke device can include any of the features in this paragraph, wherein the one or more processors, the smoke sensor, and the alarm are disposed within a housing. Additional example embodiments of the invention provide, among other things, a monitoring system comprising a plurality of smoke devices according to any of the above features in this paragraph.

Additional example embodiments of the invention provide, among other things, a method for monitoring a location comprising: receiving signals from a plurality of smoke sensors and determining one or more minutiae from the received signals, the smoke sensors comprising at least one sensor selected and/or configured to detect smoldering fire, and at least one or more sensors selected and/or configured to detect fast flaming fire; evaluating the one or more of the one or more minutiae and distinguishing the one or more of the one or more minutiae as corresponding to either a slow progressing fire type or at least one fire type other than a slow progressing fire type; setting one or more alarm levels based on the distinguished slow progressing fire type or the at least one fire type other than the slow progressing fire type; and evaluating at least one minutiae using the set one or more alarm levels and outputting an alarm signal if an alarm condition is determined. An example method can include any of the features in this paragraph, wherein the one or more minutiae comprises one or more of signal amplitude, signal velocity, signal acceleration, average signal amplitude, average signal velocity, or average signal acceleration. An example method can include any of the features in this paragraph, wherein the signal amplitude comprises one or more of absolute signal amplitude or an amplitude differential; and wherein the signal velocity and signal acceleration are determined from the signal amplitude. An example method can include any of the features in this paragraph, wherein the evaluating the one or more minutiae comprises comparing the one or more of the one or more minutiae to one or more parameters corresponding to characteristics of the progressing fire type or the at least one fire type other than the slow progressing fire type. An example method can include any of the features in this paragraph, wherein the one or more parameters are stored in a memory. An example method can include any of the features in this paragraph, further comprising: accessing a memory storing the one or more parameters. An example method can include any of the features in this paragraph, further comprising: filtering the signals from the smoke sensor; wherein said one or more minutiae is determined from the filtered signals. An example method can include any of the features in this paragraph, further comprising: activating an alarm in response to the output alarm signal.

Additional example embodiments of the invention provide, among other things, a method for monitoring a location performed by one or more processors, the method comprising: receiving signals from multiple smoke sensors including at least one sensor selected and/or configured to detect smoldering fire, and at least one or more sensors selected and/or configured to detect fast flaming fire; determining one or more minutiae from the received signals; distinguishing the one or more of the one or more minutiae as corresponding to either a slow progressing fire type or at least one fire type other than a slow progressing fire type; dynamically setting one or more alarm levels based on the distinguished slow progressing fire type or the at least one fire type other than the slow progressing fire type; evaluating at least one of the one or more minutiae using the determined one or more alarm levels; and outputting an alarm signal if an alarm condition is determined.

Some embodiments of the present disclosure, or portions thereof, may combine one or more hardware components such as microprocessors, microcontrollers, or digital sequential logic, etc., such as a processor, or processors, with one or more software components (e.g., program code, firmware, resident software, micro-code, etc.) stored in a tangible computer-readable memory device, that in combination form a specifically configured apparatus that performs the functions as described herein. These combinations that form specially-programmed devices may be generally referred to herein as modules. The software component portions of the modules may be written in any computer language and may be a portion of a monolithic code base, or may be developed in more discrete code portions such as is typical in object-oriented computer languages. In addition, the modules may be distributed across a plurality of computer platforms, servers, terminals, mobile devices, and the like. A given module may even be implemented such that the described functions are performed by separate processors and/or computing hardware platforms.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

While particular embodiments of the present smoke device have been shown and described, it will be appreciated by those skilled in the art that changes and modifications may be made thereto without departing from the invention in its broader aspects and as set forth in the following claims.

The invention claimed is:

1. A detection circuit embodied in one or more processors for monitoring a location, the detection circuit comprising:

a minutiae computer module configured for receiving signals from a smoke sensor and determining one or more minutiae from the received signals;

a ripple detector start/reset timer module configured for receiving at least one of the determined one or more minutiae and determining at least a start time for evaluating one or more of the one or more minutiae;

a scheduler/minutia analyzer and fire type probability analyzer module configured for evaluating the one or more of the determined one or more minutiae and characterizing the one or more of the one or more minutiae according to one or more smoke or fire types;

a fire type and alarm level selector configured for setting one or more alarm levels based on the characterized one or more smoke or fire types; and an alarm level detector for evaluating at least one minutiae using the set one or more alarm levels and outputting an alarm signal if an alarm condition is determined;

wherein the one or more minutiae comprises one or more of signal amplitude, signal velocity, signal acceleration, average signal amplitude, average signal velocity, or average signal acceleration;

wherein the signal amplitude comprises one or more of absolute signal amplitude or an amplitude differential; and wherein the signal velocity and signal acceleration are determined from the signal amplitude.

2. The detection circuit of claim 1, wherein the evaluating the one or more minutiae by the scheduler/minutia analyzer and fire type probability analyzer module comprises comparing the one or more of the one or more minutiae to one or more parameters corresponding to characteristics of the one or more smoke or fire types.

3. A smoke device comprising:

the detection circuit of claim 1;

the smoke sensor in communication with the minutiae computer module; and an alarm in communication with the alarm level detector.

4. The smoke device of claim 3, wherein the detection circuit, the smoke sensor, and the alarm are disposed in a housing.

5. The smoke device of claim 4, wherein the smoke device is a smoke detector or a smoke alarm.

6. The smoke device of claim 4, wherein the smoke device is a fire panel.

7. A method for monitoring a location comprising:

receiving signals from a smoke sensor and determining one or more minutiae from the received signals;

receiving the determined one or more minutiae and determining at least a start time for evaluating one or more of the one or more minutiae based on some or all of said determined one or more minutiae;

evaluating the one or more of the one or more minutiae and characterizing the one or more minutiae according to one or more smoke or fire types;

dynamically setting one or more alarm levels based on the characterized one or more smoke or fire types; and evaluating at least one minutiae using the set one or more alarm levels and outputting an alarm signal if an alarm condition is determined;

wherein the one or more minutiae comprises one or more of signal amplitude, signal velocity, signal acceleration, average signal amplitude, average signal velocity, or average signal acceleration;

wherein the signal amplitude comprises one or more of absolute signal amplitude or an amplitude differential; and wherein the signal velocity and signal acceleration are determined from the signal amplitude.

8. The method of claim 7, wherein the evaluating the one or more minutiae by the scheduler/minutia analyzer and fire type probability analyzer module comprises comparing the one or more of the one or more minutiae to one or more parameters corresponding to characteristics of the one or more smoke or fire types.

9. The method of claim 7, further comprising:

activating an alarm in response to the output alarm signal.

* * * * *